US007379693B2

(12) United States Patent
Ogawa et al.

(10) Patent No.: US 7,379,693 B2
(45) Date of Patent: May 27, 2008

(54) DEVELOPING APPARATUS

(75) Inventors: Kenya Ogawa, Susono (JP); Yasushi Shimizu, Shizuoka-ken (JP); Shuji Moriya, Shizuoka-ken (JP); Kazunari Hagiwara, Numazu (JP); Naoto Kichijima, Mishima (JP); Koichi Okuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 225 days.

(21) Appl. No.: 11/402,022

(22) Filed: Apr. 12, 2006

(65) Prior Publication Data

US 2006/0233572 A1 Oct. 19, 2006

(30) Foreign Application Priority Data

Apr. 18, 2005 (JP) ..... 2005-119980

(51) Int. Cl.
*G03G 15/09* (2006.01)

(52) U.S. Cl. ..... 399/274; 399/277

(58) Field of Classification Search ..... 399/267, 399/270, 272, 274–277, 279, 282, 284–286
See application file for complete search history.

(56) References Cited

U.S. PATENT DOCUMENTS

| | | | | |
|---|---|---|---|---|
| 4,292,387 | A | 9/1981 | Kanbe et al. | 430/102 |
| 4,395,476 | A | 7/1983 | Kanbe et al. | 430/102 |
| 4,913,088 | A | 4/1990 | Kanbe et al. | 118/651 |
| 5,096,798 | A | 3/1992 | Kanbe et al. | 430/120 |
| 5,122,838 | A | 6/1992 | Kohyama | 399/150 |
| 5,194,359 | A | 3/1993 | Kanbe et al. | 430/120 |
| 5,424,814 | A * | 6/1995 | Suzuki et al. | 399/284 |
| 6,035,169 | A * | 3/2000 | Miyake et al. | 399/258 |
| 6,128,456 | A | 10/2000 | Chigono et al. | 399/176 |
| 6,473,586 | B2 | 10/2002 | Noda et al. | 399/275 |
| 6,630,275 | B2 | 10/2003 | Hiratsuka et al. | |
| 2005/0152718 | A1 | 7/2005 | Osada et al. | |
| 2005/0196201 | A1 | 9/2005 | Hagiwara et al. | |
| 2005/0214031 | A1 | 9/2005 | Hagiwara et al. | |

(Continued)

FOREIGN PATENT DOCUMENTS

JP 54-43027 4/1979

(Continued)

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

A developing apparatus having a rotatable developing sleeve having an elastic layer on the surface thereof for carrying a mono-component magnetic developer and urged against a photosensitive drum to develop an electrostatic image formed on the drum with the developer, a non-rotary magnet provided inside the sleeve for magnetically attracting the developer to the sleeve, and a blade having an abutting portion abutting against the sleeve in a counter direction for regulating the amount of the developer on the sleeve, a step portion spaced apart from the abutting portion, and a separating portion provided upstream of the step portion in the rotation direction of the sleeve, wherein the surface of the sleeve to which the separating portion is opposed includes a position satisfying $|Br|/|B| \geqq 0.5$, where B(G): the magnitude of magnetic flux density formed on the surface of the sleeve, and Br(G): a component of the magnetic flux density in a direction perpendicular to the surface of the sleeve.

16 Claims, 10 Drawing Sheets

U.S. PATENT DOCUMENTS

| | | | |
|---|---|---|---|
| 2006/0171745 | A1 | 8/2006 | Hagiwara et al. |
| 2006/0233573 | A1 | 10/2006 | Kichijima et al. |

FOREIGN PATENT DOCUMENTS

| | | | | |
|---|---|---|---|---|
| JP | 55-18656 | | | 2/1980 |
| JP | 58-97071 | A | | 6/1983 |
| JP | 1-96674 | | | 4/1989 |
| JP | 3-4276 | | | 1/1991 |
| JP | 4-15949 | B2 | | 3/1992 |
| JP | 10-83118 | | | 3/1998 |
| JP | 10-307455 | | | 11/1998 |
| JP | 2001-92201 | | | 4/2001 |
| JP | 2002-341590 | A | | 11/2002 |
| JP | 2003-84563 | A | | 3/2003 |
| JP | 2005283845 | A | * | 10/2005 |

* cited by examiner

POLE ARRANGEMENT AND HAIR LINE UNIFORMITY

POLE ARRANGEMENT AND SOLID BLACK UNIFORMITY

COMPREHENSIVE EVALUATION

DEVELOPING APPARATUS

BACKGROUND OF THE INVENTION

1. Field of the Invention

The invention relates to a developing apparatus for developing an electrostatic image formed on an image bearing member with a developer, and more particularly to a developing apparatus of a mono-component developing type having a developer carrying member urged against an image bearing member.

Also, as the image bearing member, use can be made, for example, of an electrophotographic photosensitive member, an electrostatic recording dielectric member or the like, and the developing apparatus can be provided in a cartridge detachably mountable on an image recording apparatus (image forming apparatus) such as a copying machine or a printer, or an image forming apparatus main body.

2. Description of the Related Art

For example, in an electrophotographic image forming apparatus, (1) a nonmagnetic contact developing type and (2) a magnetic non-contact developing type are widely used as conventional mono-component developing types for developing an electrostatic latent image formed on an electrophotographic photosensitive member as a member to be developed (image bearing member) with a mono-component developer.

(1) Nonmagnetic Contact Developing Type

There has been proposed a type in which a nonmagnetic developer is carried on a developing roller (developer carrying member) having a dielectric material layer and is brought into contact with the surface of a photosensitive member to thereby effect development (see, for example, Japanese Patent Application Laid-open No. 2001-92201). The developer in a developing apparatus is supplied to the vicinity of the developing roller by a mechanical agitating mechanism or gravity. An elastic roller for contacting with the developing roller is provided and effects the conveyance and supply of the developer. This elastic roller also has the function of once removing any developer not shifted to the photosensitive member, but remaining on the developing roller, for the purpose of uniformizing the developer on the developing roller. A DC bias is applied to between the base material of the photosensitive member and the developing roller.

(2) Magnetic Non-Contact Developing Type

This type (see, for example, Japanese Patent Application Laid-open No. S54-43027 and Japanese Patent Application S55-18656) uses a magnetic mono-component developer, and carries the developer on a developing sleeve (developer carrying member) containing a magnet therein, and opposes the developing sleeve to a photosensitive member with a predetermined minute gap kept from the surface of the developing sleeve, and effects development by the developer flying in this gap. The developer in a developing apparatus is conveyed to the developing sleeve by a mechanical agitating mechanism or gravity and also, the developer receives a constant magnetic force by the magnet and is supplied to the developing sleeve. Then, a predetermined developer layer is formed on the developing sleeve by regulating means, and is used for development. The force acting on the developer by the magnet is positively used not only for the conveyance of the developer, but also in a developing portion. In the developing portion, the developer is prevented from shifting to a non-image portion to thereby cause a faulty image such as fog. This is because during development, the developer travels toward the magnet contained in the developing sleeve and receives the magnetic force. For the flight of the developer, use is made of a bias comprising an AC bias superimposed on a DC bias. The DC bias voltage is adjusted to a value between the image portion potential and non-image portion potential of the photosensitive member. Further, an AC voltage is superimposed, and the developer is reciprocally moved to the image portion and the non-image portion, whereby the image portion is developed with the developer.

(3) Cleaner-Less (Toner Recycle) System

From the viewpoints of the simplification of an apparatus construction and the elimination of waste, in an image forming apparatus of a transfer type, there has been proposed an electrophotographic process which disuses an exclusive drum cleaner which is surface cleaning means for a photosensitive member after the transferring step, and recycles a toner in the apparatus. For example, there has been proposed an image forming apparatus which uses the aforedescribed nonmagnetic contact developing type to collect any developer untransferred and residual simultaneously with the time of development (see, for example, Japanese Patent Application Laid-open No. H03-4276).

There has also been proposed an image forming apparatus which uses the aforedescribed magnetic non-contact developing type to collect any developer untransferred and residual simultaneously with the time of development (see, for example, Japanese Patent Application Laid-open No. H10-307455).

In the conventional nonmagnetic contact developing type mentioned under item (1) above, a reduction in the fog performance during endurance has been a problem. The characteristic of the toner is lowered while the mechanical stripping-off by the elastic roller is repeated, and the fog is sometimes aggravated by the lowering of the frictional charging characteristic or the like of the toner. The fog refers to the image fault that the toner is slightly developed in a blank portion (unexposed portion) which is originally not printed and appears like a ground stain. For the prevention of the lowering of the toner characteristic, it is also possible to weaken the frictionally contacting force of the elastic roller, but the compatibility with a ghost image fault is difficult. Here, the ghost image is the phenomenon that in a halftone image wherein the hysteresis of a toner amount developed in the previous rotation of the developing roller is uniform in the next and subsequent rotations, uneven image density appears with the phase difference of the outer periphery of the developing roller. Also, the presence of the ghost means that there is some toner which is not stripped off but is residual on the developing roller.

That is, the toner continuously receives the frictional contact by the elastic roller and this is not preferable also from the viewpoint of the lowering of the characteristic of the toner. The adjustment of the frictionally contacting force has the problem of not only being contrary from the viewpoints of fog and ghost, but also being contrary in the problem of fog singly.

Also, when the toner characteristic becomes lowered, there has also arisen the problem that the toner is liable to be affected by the circulation thereof in a developing device. Specifically, in mechanical circulation or circulation using gravity, there is formed an area in which the agent (the developer or the toner) hardly changes places and does not circulate particularly around the developing roller. On the other hand, the predetermined lowering of the characteristic occurs to the circulating agent. Thus, when the toner in a container has been decreased, the two kinds of agents are mixed together to thereby cause condensation or the like, and has given rise to the problem of fog or the like. Further, there is an image fault attributable to the elastic roller itself.

On the other hand, in the magnetic non-contact developing type under item (2) above, there is an image fault due to a magnetic ear. There is the problem that the uniformity of a hair line differs lengthwise and breadthwise. When the magnetic ear develops while moving in parallelism to the movement direction of a photosensitive member (photosensitive drum), the uniformity of the hair line is good and is liable to break off in a direction orthogonal thereto. Also, an image edge fault is caused. The edge of a high image density portion, particularly the downstream side of the process is developed darkly, and the edge of a halftone portion adjacent to the high image density portion is developed lightly. The factor is expected to reside in developing in non-contact while reciprocally moving the developer by an AC electric field (FIGS. 9A and 9B of the accompanying drawings). In the developing portion, the toner is moved toward a surface and particularly, the toner stagnates downstream of the edge portion and conversely, the toner is drawn near from the outside of the edge to thereby cause the image fault as described above. Further, in the image forming apparatus of the cleaner-less system, because of non-contact, the capability of collecting the toner on the photosensitive drum is low, and this leads to the problem that the untransferred residual toner becomes a ghost and appears in solid white or a halftone. Also, a white spot occurs in solid black. This white spot is liable to occur when paper dust gets mixed between the developing roller and the photosensitive drum under a high temperature and high humidity. This is expected to be because bias leak has occurred between the developing roller and the photosensitive drum with a result that the potential of the latent image on the photosensitive drum has risen (to the negative).

SUMMARY OF THE INVENTION

It is an object of the present invention to provide a developing apparatus which suppresses an image fault.

It is another object of the present invention to provide a developing apparatus which prevents fog.

It is another object of the present invention to provide a developing apparatus which prevents the occurrence of a ghost image.

It is another object of the present invention to provide a developing apparatus which prevents uneven image density.

It is another object of the present invention to provide a developing apparatus which improves the uniformity of a hair line.

It is another object of the present invention to provide a developing apparatus which prevents an image edge from becoming dark or light.

DESCRIPTION OF THE PREFERRED EMBODIMENTS

Example 1 of the Image Forming Apparatus

Figure 1:
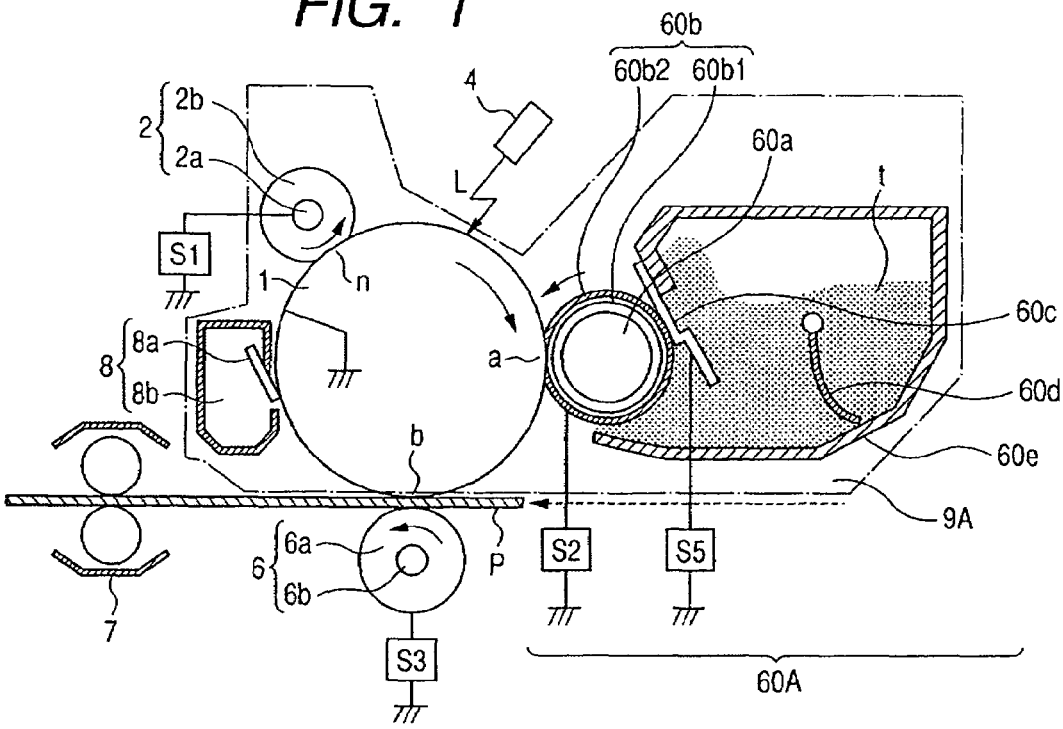
FIG. 1 is schematic view of Example 1 of an image forming apparatus using Embodiment 1 of the present invention.

FIG. 1 schematically shows the construction of an image recording apparatus (image forming apparatus) using a developing apparatus according to the present invention. This image recording apparatus is a laser printer utilizing a transfer type electrophotographic process.

(1) General Schematic Construction of the Image Recording Apparatus

The reference numeral 1 designates a photosensitive member which is an image bearing member (member to be developed), and in the present example, it is a rotary drum-shaped negative polarity OPC photosensitive member (negative photosensitive member, hereinafter referred to as the photosensitive drum) of ϕ24 mm. This photosensitive drum 1 is rotatively driven in the clockwise direction of arrow at a constant speed of a peripheral speed of 85 mm/sec. (=process speed PS, i.e., printing speed).

The reference numeral 2 denotes a charging roller as charging means for the photosensitive drum 1. This charging roller 2 is an electrically conductive elastic roller, and the reference character 2*a* designates a mandrel, and the reference character 2*b* denotes an electrically conductive elastic layer. This charging roller 2 is brought into pressure contact with the photosensitive drum 1 with a predetermined pressure force to thereby form a charging portion n between it and the photosensitive drum 1. In the present example, this charging roller 2 is driven to rotate by the rotation of the photosensitive drum 1.

The reference character S1 designates a charging voltage source for applying a charging bias to the charging roller 2. In the present example, a DC voltage equal to or greater than a discharge starting voltage is applied from this charging voltage source S1 to the charging roller 2. Specifically, a DC voltage of −1300V is applied as the charging bias to thereby uniformly contact-charge the surface of the photosensitive drum 1 to charging potential (dark portion potential) of −700V.

The reference numeral 4 denotes a laser beam scanner (exposing apparatus) including a laser diode, a polygon mirror, etc. This laser beam scanner 4 outputs a laser beam intensity-modulated correspondingly to the time serial electrical digital pixel signal of desired image information, and scans and exposes L the charged surface of the rotary photosensitive drum 1 to the laser beam. The laser power is adjusted so that the potential of the surface of the photosensitive drum 1 may be −150V when the charged surface of the photosensitive drum 1 is generally exposed to the laser beam.

By this scanning and exposure L, an electrostatic latent image corresponding to the desired image information is formed on the surface of the photosensitive drum 1.

The reference character 60A designates a developing apparatus (developing device) according to Embodiment 1 which will be described later. A developer (hereinafter referred to as the toner) "t" bears constant triboelectric charge to the negative polarity, and visualizes the electrostatic latent image on the photosensitive drum 1 in a developing area "a" by a development bias applied to between a developing sleeve 60*b* as a developer carrying member (toner carrying member) and the photosensitive drum 1 by a development bias applying voltage source S2.

The developing apparatus 60 will be described in detail in each embodiment and each comparative example which will be described later.

The reference numeral 6 denotes a transfer roller of medium resistance as contact transferring means, and it is brought into predetermined pressure contact with the photosensitive drum 1 to thereby form a transfer nip portion b. A transfer material P as a recording medium is fed from a sheet feeding portion, not shown, to this transfer nip portion "b" at predetermined timing, and a predetermined transfer bias voltage is applied from a transfer bias applying voltage source S3 to the transfer roller 6, whereby the toner image on the photosensitive drum 1 is sequentially transferred to the surface of the transfer material P fed to the transfer nip portion "b".

The transfer roller 6 used in the present example is a roller of a resistance value of $5\times10^8\Omega$ comprising a mandrel 6*a* and a medium-resistance foamed layer 6*b* formed thereon, and a voltage of +2.0 kV was applied to the mandrel 6*a* to thereby effect transfer. The transfer material P introduced into the transfer nip portion "b" is nipped by and conveyed through this transfer nip portion b, and the toner image formed and borne on the surface of the rotary photosensitive drum 1 is sequentially transferred to the surface of the transfer material P by an electrostatic force and a pressure force.

The reference numeral 7 designates a fixing device of a heat fixing type or the like. The transfer material P fed to the transfer nip portion "b" and having received the transfer of the toner image on the photosensitive drum 1 is separated from the surface of the rotary photosensitive drum 1 and is introduced into this fixing device 7, and is subjected to the fixing of the toner image and is discharged out of the apparatus as an image formed article (a print or a copy).

The reference numeral 8 denotes a drum cleaning device for scraping off any untransferred toner residual on the photosensitive drum by a cleaning blade 8*a* and collecting it into a waste toner container 8*b*.

Then, the photosensitive drum 1 is again charged by the charging device 2 and is repeatedly used for image formation.

The reference character 9A designates a cartridge (process cartridge) having the photosensitive drum 1, the charging roller 2, the developing apparatus 60 and the drum cleaner 8 integrally formed therein, and this cartridge is made detachably mountable with respect to the image forming apparatus.

Example 2 of the Image Forming Apparatus

Figure 2:
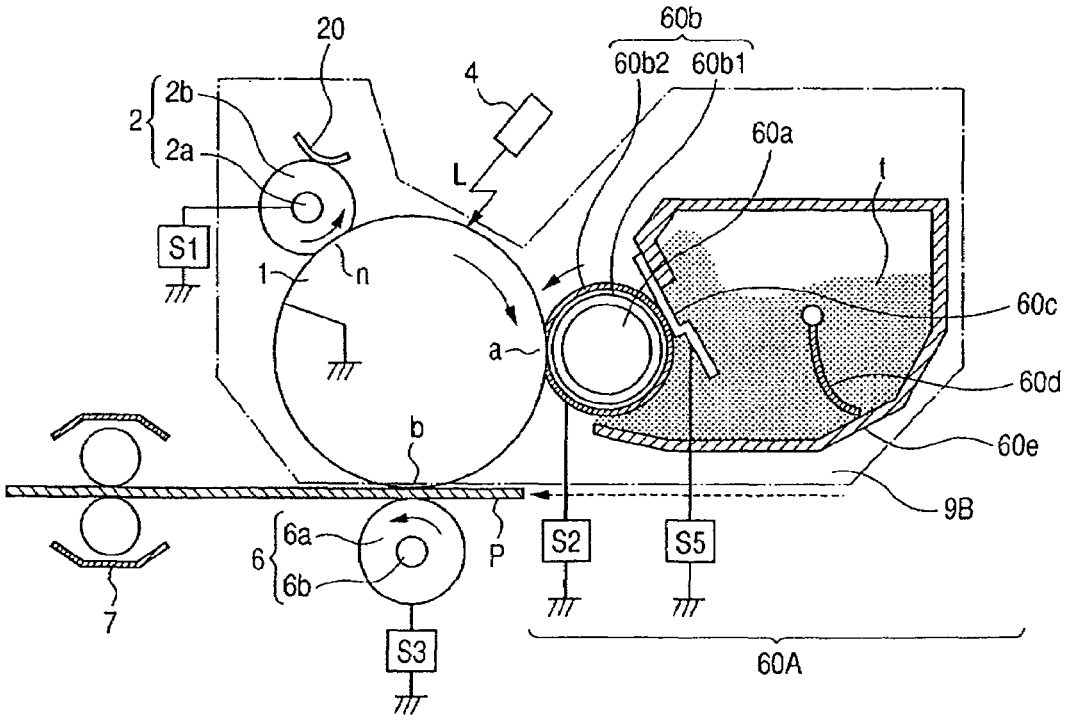
FIG. 2 is a schematic view of Example 2 of the image forming apparatus using Embodiment 1 of the present invention.

FIG. 2 schematically shows the construction of an image recording apparatus according to a second embodiment using the developing apparatus of the present invention. The image recording apparatus according to the present embodiment is a laser printer utilizing a transfer type electrophotographic process and a toner recycle process (cleaner-less system). The points of this example similar to those of the aforedescribed Example 2 of the image forming apparatus need not be described again, and only the different points thereof will hereinafter be described.

The most different point of the present embodiment is that the exclusive drum cleaner is disused and the untransferred residual toner is recycled. The toner is circulated so that the untransferred residual toner may not adversely affect the charging and other processes, and is collected in the developing device. Specifically, the following construction is changed relative to Example 1 of the image forming apparatus.

Regarding the charging, a charging roller similar to the charging roller 2 in Example 1 of the image forming apparatus is used, but in the present embodiment, the driving of the charging roller is effected. The number of revolutions of the charging roller is adjusted so that the speed of the surface of the charging roller and the surface speed (process speed) of the photosensitive drum may be the same. By the charging roller being driven, the charging roller reliably contacts with the photosensitive member and an abutting member 20, and charges the toner to minus (regular polarity). Also, the charging roller is provided with a charging roller abutting member 20 for the purpose of preventing the stains by the toner. Even when the charging roller is stained by the toner of a polarity (plus polarity) opposite to the charging polarity thereof, the charges of the toner can be charged from plus to minus. The toner charged to minus becomes capable of being quickly discharged from the charging roller and collected in the developing device 60 by cleaning simultaneous with developing. Polyimide film of 100 μm was used as the abutting member 20, and was made to abut against the charging roller with line pressure of 10 (N/m) or less. Polyimide was used because it has a frictional charging characteristic giving negative charges to the toner.

The reference character 9B designates a cartridge (process cartridge) having the photosensitive drum 1, the charging roller 2, the charging roller abutting member 20 and the developing apparatus 60 integrally formed therein, and it is made detachably mountable with respect to the image forming apparatus.

EMBODIMENTS AND COMPARATIVE EXAMPLES

Embodiment 1

Contact, Elastic Sleeve, Inter-Pole Position Regulating Portion, Pole Position Separating Portion and (Step Blade)

Description will hereinafter be made of a developing apparatus 60A (FIGS. 1 and 2) according to the present embodiment. The reference character 60*b* denotes a developing sleeve as a developer carrying member (developer carrying and conveying member) including therein a magnet roll 60*a* as fixed unrotary magnetic field generating means. The developing sleeve 60*b* is comprised of an aluminum cylinder 60*b*1 and a nonmagnetic electrically conductive elastic layer 60*b*2 formed thereon, and is brought into contact with the photosensitive drum 1 with a constant pressure amount. The pressure between the photosensitive drum and the developing sleeve was adjusted so as to be 200 N/m in terms of pulling-out pressure. The pulling-out pressure is a value corresponding to line pressure obtained by an SUS plate having a thickness of 30 μm sandwiched between two SUS plates also having a thickness of 30 μm being sandwiched between two members made to abut against each other, and the force with which the SUS plate is pulled out being converted per length 1 m of the SUS plate.

A method of manufacturing the developing sleeve 60*b* was to knead a material providing the nonmagnetic electrically conductive elastic layer 60*b*2, extrusion-mold it and adhesively secure it as the elastic layer 60*b*2 onto the aluminum sleeve 60*b*1, and polish this layer 60*b*2 to a thickness of 500 μm after the adhesive securing. The micro rubber hardness of the developing sleeve 60*b* was 72 degrees, and the surface roughness thereof was 3.8 μm in terms of Rz and 0.6 μm in terms of Ra.

In the present embodiment, the measurement of surface hardness was effected by the use of a micro rubber hardness meter (ASKER MD-1F 360A: produced by Kobunshi Keiki Co., Ltd.). For the measurement of the surface roughness, use was made of a contact detection unit PU-DJ2S as Surfcorder SE3400 produced by Kosaka Laboratory Ltd., and as measuring conditions, a measurement length 2.5 mm, a vertical direction magnification 2,000 times, a horizontal direction magnification 100 times, cut-off 0.8 mm, filter setting 2 CR and levelling setting were effected by front data.

Figure 3A:
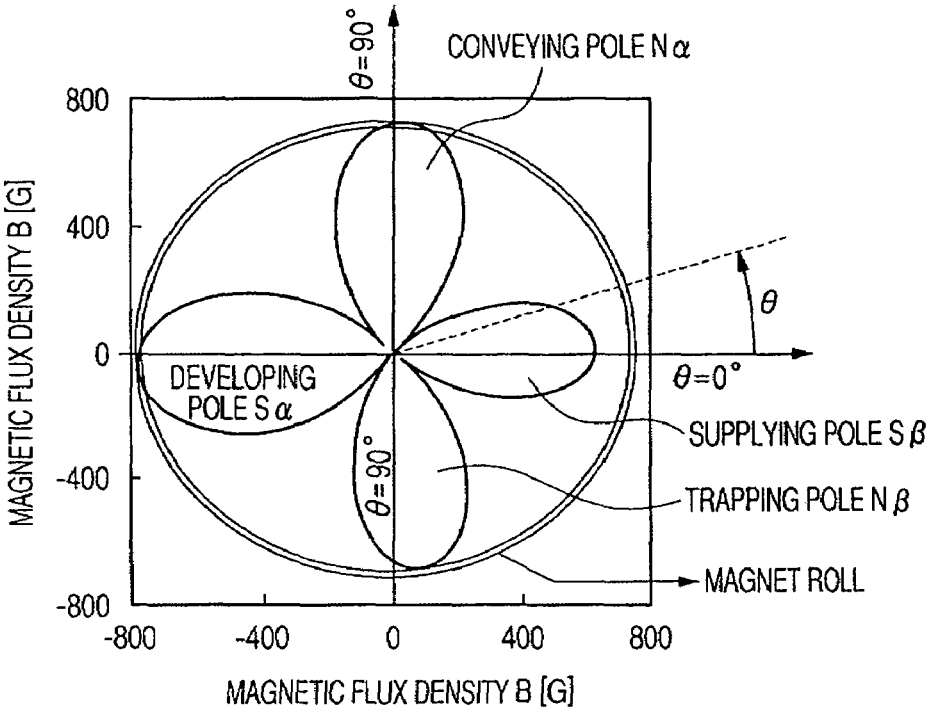
FIGS. 3A and 3B show the magnetic flux density of a magnet roll used in Embodiment 1 and |Br|/|B|.

The magnet roll 60*a* is a stationary magnet as magnetic field generating means for generating a magnetic force at each place on the developing sleeve. As shown in FIG. 3A, it has peak density at each of a developing portion Sα, a conveying Nα, a supplying portion Sβ and a trapping portion Nβ.

The measurement of magnetic flux density in the present embodiment was effected by the use of a Gauss meter Series 9900 and a probe A-99-153 produced by F.W. Bell. This Gauss meter has a bar-shaped axial probe connected to a Gauss meter main body. The developing sleeve is horizontally fixed, and the magnet roll therein is rotatably mounted. The probe in a horizontal posture is disposed at a right angle with some interval kept relative to this developing sleeve, and is fixed so that the center of the developing sleeve and the center of the probe may be located on substantially the same horizontal plane, and in that state, the magnetic flux density is measured. The magnet roll is a cylinder member substantially concentric with the developing sleeve, and the interval between the developing sleeve and the magnet roll may be considered to be equal everywhere. Accordingly, the magnetic flux density at the surface position on the developing sleeve and the magnetic flux density in the direction of a normal at the surface position are measured while the magnet roll is rotated, whereby this measurement can replace what has been measured at all positions with respect to the peripheral direction of the developing sleeve. Peak intensity at each position on the surface of the sleeve was found from the obtained magnetic flux density data in the peripheral direction, and was defined as Br. Next, a probe horizontally disposed is rotated by 90° in the tangential direction of the peripheral direction of the developing sleeve, and the magnet roll is rotated, whereby magnetic flux density at the surface position of the developing sleeve and magnetic flux density in the tangential direction at the surface position were measured, and were defined as Bθ.

From the values of Br and Bθ at each angle, the magnitude $|B|=|Br^2+B\theta^2|^{1/2}$ of the magnetic flux density B was calculated.

Next, the ratio (|Br|/|B|) of the magnitude |Br| of a sleeve surface vertical component to the magnitude |B| of the magnetic flux density was found.

Figure 3B:
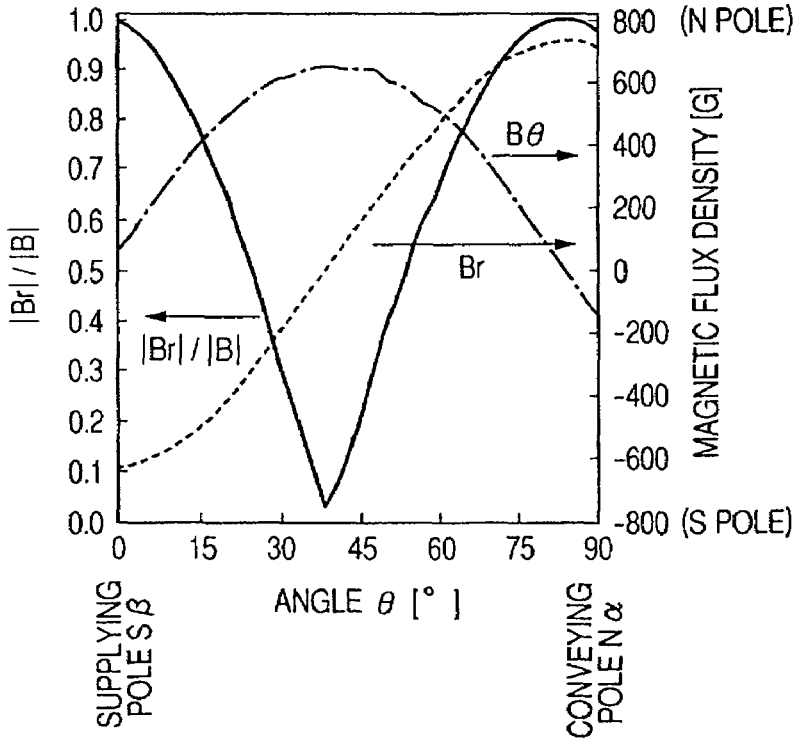

The result and Br and Bθ are shown in FIG. 3B. The angle of the axis of abscissas is plotted with the origin taken at the supplying portion Sβ pole, and the positive direction is a downstream direction (Sβ→Nα→Sα→Nβ→Sβ) with respect to the rotation direction of the sleeve. The right axis of ordinates indicates the intensity of the magnetic flux density, but the N pole is defined as positive and the S pole is defined as negative, and the left axis of ordinates indicates |B|/|B|.

Toner t1: in the present embodiment, as the mono-component magnetic toner "t" which is the developer, use was made of a toner t1 manufactured by binding resin, magnetic material particles and a charge controlling agent being mixed together, and being subjected to the steps of kneading, crushing, surface quality improving process and classifying, and manufactured by a fluidizing agent being added as an extraneous additive (crushing method, e.g. Japanese Patent Application Laid-open No. 2002-341590). The magnetic material particles were prescribed by the same weight as the binding resin to thereby manufacture magnetic particles capable of being conveyed by a sufficient magnetic force. Also, the toner t1 is negatively chargeable, and the mean particle diameter (D4) thereof was 7 μm.

The toner t1 is subjected to layer thickness regulation (developer amount regulation) and charge imparting by a regulating blade 60*c* as a developer amount regulating member in the process of being conveyed on the developing sleeve 60*b* while receiving the magnetic force of the magnet roll 60*a*. The reference character 60*d* designates an agitating member for effecting the circulation of the toner in a developer container 60*e* and sequentially conveying the toner to within a magnetic force reach range around the sleeve.

The present developing apparatus uses phosphor bronze having a thickness of 100 μm as the regulating blade 60*c*, and further in order to obtain an effect in the present invention, the regulating blade thereof is formed with an abutting portion for abutting against the sleeve to thereby regulate the toner amount and at the same time, effect frictional charging, a step portion formed from the abutting portion in an opposite direction away from the sleeve and in a substantially vertical direction, and a separating portion provided upstream of the step portion with respect to the rotation direction of the sleeve. The regulating blade is provided so as to abut in a counter direction to the rotation direction of the developing sleeve. That is, the abutting portion of the regulating blade against the developing sleeve is provided downstream of the free end of the regulating blade with respect to the rotation direction of the developing sleeve.

Here, the abutting portion position (regulating position) of the regulating blade was set to θ=40° (|Br|/|B|=0.03) in FIGS. 3A and 3B, pulling-out pressure 50 (N/m), blade step portion length 1 mm and blade separating portion length 5 mm. Here, the blade step portion length is the shortest distance between the abutting portion and separating portion of the regulating blade 60*c*, and the blade separating portion length means the length of the free end when the step portion of the regulating blade 60*c* is defined as a starting point. Also, it will hereinafter be called inter-pole position regulation (inter-pole regulation) to set the abutting position of the regulating blade against the developing sleeve at a magnetic pole area (|Br|/|B|<0.5) in which a horizontal magnetic field is dominant as in the present embodiment. At this time, the separating portion position of the regulating blade was set to θ=7° (|Br|/|B|=0.96) in FIGS. 3A and 3B in the rotation direction of the developing sleeve. The area (|Br|/|B|≧0.5) in which the magnetic field of the developing sleeve in the diametral direction thereof is dominant as described above is called a magnetic pole position.

In the present embodiment, it is to be understood that the magnetic field (magnetic flux density) at the abutting position of the regulating blade is the value of Br and Bθ in FIG. 3B at an angle θ formed between the central position of the abutting nip between the regulating blade and the developing sleeve and the center of the developing sleeve, and that the magnetic field on the separating portion of the regulating blade is the value of Br and Bθ in FIG. 3B at angle θ formed between the free end of the regulating blade in the separating portion thereof and the center of the developing sleeve. In the present embodiment, there is not provided the elastic roller for contacting with the developing sleeve and supplying the developer. That is, the member which contacts with the developing sleeve at first after the developing sleeve has contacted with the photosensitive member is the regulating blade.

Further, the toner t1 coating the developing sleeve 60*b* is conveyed to a developing region (developing area portion) "a" which is the opposed portion between the photosensitive drum 1 and the sleeve 60*a* by the rotation of the sleeve 60*a*. Also, a development bias (DC voltage of −450V) is applied from the development bias applying voltage source S2 to the sleeve 60*a*.

Further, a DC voltage source S5 is connected to the regulating blade, and a blade bias voltage (DC voltage of −550V) is applied thereto. While here, −550V is applied as the blade bias, the blade bias can be of the same polarity as the toner relative to the DC value of the development bias, and by applying a voltage of −50 to −250V with the development bias as the reference, the effect in the present invention could be sufficiently obtained. Here, the developing sleeve is driven at a peripheral speed 1.2 times as high as that of the photosensitive drum. Thereby, the electrostatic latent image on the photosensitive drum 1 is reversal-developed with the toner t1. Also, the peripheral speed of the developing sleeve relative to the photosensitive drum is 1.2 times, but if the peripheral speed of the developing sleeve relative to the photosensitive drum is 1.0 to 2.0 times, the effect of the present invention can be sufficiently obtained.

Embodiment 2

Contact, Elastic Sleeve, Pole Position Regulating Portion, and Pole Position Separating Portion (Step Blade)

A developing apparatus according to the present embodiment basically corresponds to the developing apparatus 60A described in Embodiment 1, but differs in the abutting conditions of the regulating blade against the elastic sleeve from Embodiment 1.

In the present embodiment, the abutting position of the regulating blade was set to θ=16°, pulling-out pressure 50 (N/m) and blade separating portion length 5 mm in FIGS. 3A and 3B.

The magnetic field of the regulating portion in the present embodiment was |Br|/|B|=0.80, and the magnetic field of the separating portion was |Br|/|B|=0.77.

Also, it will hereinafter be called pole position regulation (pole regulation) to set the abutting position of the regulating blade against the developing sleeve to a magnetic pole area (|Br|/|B|≧0.5) in which a vertical magnetic field is dominant as in the present embodiment.

Embodiment 3

Contact, Elastic Sleeve, Inter-Pole Position Regulating Portion and Pole Position Separating Portion (Step Blade)

A developing apparatus according to the present embodiment basically corresponds to the developing apparatus 60A described in Embodiment 1, but the bias applied to the regulating blade is at potential equal to that applied to the developing sleeve.

Comparative Example 1

Contact, Elastic Sleeve, Inter-Pole Position Regulating Portion and Inter-Pole Position Separating Portion (Step Blade)

A developing apparatus according to the present comparative example basically corresponds to the developing apparatus 60A described in Embodiment 1, but differs in the abutting conditions of the regulating blade against the elastic sleeve from Embodiment 1.

In the present example, the abutting position of the regulating blade was set to θ=52°, pulling-out pressure 50 (N/m) and blade separating portion length 3 mm in FIGS. 3A and 3B.

The magnetic field of the regulating portion in the present comparative example was |Br|/|B|=0.4, and the magnetic field of the separating portion was |Br|/|B|=0.33.

Comparative Example 2

Contact, Elastic Sleeve, Pole Position Regulating Portion and Inter-Pole Position Separating Portion (Step Blade)

A developing apparatus according to the present comparative example basically corresponds to the developing apparatus 60A described in Embodiment 1, but differs in the abutting conditions of the regulating blade against the elastic sleeve from Embodiment 1.

In the present example, the abutting position of the regulating blade was set to θ=−14°, pulling-out pressure 50 (N/m) and blade separating portion length 3 mm in FIGS. 3A and 3B.

The magnetic field of the regulating portion in the present comparative example was |Br|/|B|=0.84, and the magnetic field of the separating portion was |Br|/|B|=0.16.

Comparative Example 3

Contact, Elastic Sleeve, Inter-Pole Position Regulating Portion and Inter-Pole Position Separating Portion (Straight Blade)

A developing apparatus in the present comparative example basically corresponds to the developing apparatus 60A described in Embodiment 1, but differs in the shape of the regulating blade from Embodiment 1, and the abutting portion abutting against the elastic sleeve has no step portion, and is made into a straight shape.

In the present example, the abutting position of the regulating blade was set to θ=40°, pulling-out pressure 50 (N/m) and blade separating portion length 5 mm in FIGS. 3A and 3B.

The magnetic field of the regulating portion in the present comparative example was |Brl/|B|=0.03, and the magnetic field of the separating portion was |Brl/|B|=0.99.

Comparative Example 4

Magnetic Non-Contact Developing Type and Inter-Pole Position Regulation

Figure 6:
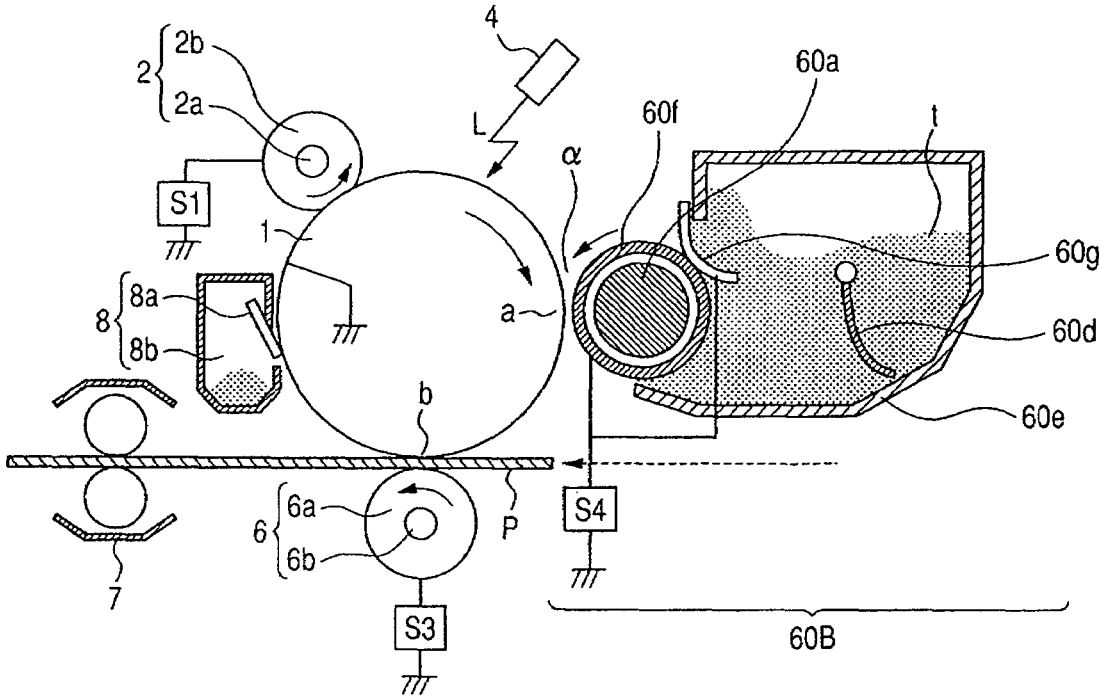
FIG. 6 is a schematic view of Example 1 of an image forming apparatus using Comparative Example 4.

A developing apparatus 60B according to the present comparative example will hereinafter be described. FIG. 6 shows a schematic view of Example 1 of an image forming apparatus using the present comparative example. A toner t2 which will be described later was used as the developer.

The reference character 60*f* designates a developing sleeve as a developer carrying and conveying member containing therein the magnet roll 60*a* used in Embodiment 1. The developing sleeve 60*f* is constituted by the surface of an aluminum cylinder having its roughness adjusted by sand blast, and is installed with a gap α of 300 μm relative to the photosensitive drum 1. The micro rubber hardness of the developing sleeve 60*f* was 100 degrees, the surface roughness Rz thereof was 11.5 μm and the surface roughness Ra thereof was 1.5 μm. The toner t2 filling the developing apparatus 60B is subjected to layer thickness regulation and charge imparting by a regulating blade 60*g* of urethane having a thickness of 1.5 mm, in the process of being conveyed on the developing sleeve 60*f* while receiving the magnetic force of the magnet roll 60*a*. The reference character 60*d* denotes an agitating member for effecting the circulation of the toner in a developer container 60*e* and sequentially conveying the toner to within a magnetic force reach range around the sleeve.

In the present developing apparatus, in order to obtain a desired toner charging amount and a desired coat amount, the abutting position of the regulating blade against the sleeve was set to θ=40° (|Brl/|B|=0.03), pulling-out pressure 30 N/m and blade free length 1 mm in FIGS. 3A and 3B. Here, the blade free length is the length from the abutting nip between the regulating blade and the developing sleeve to the free end of the regulating blade.

The toner t2 coating the developing sleeve 60*f* is conveyed to a developing region (developing area portion) "a" which is the opposed portion between the photosensitive drum 1 and the sleeve 60*f*, by the rotation of the sleeve 60*a*. Also, a development bias voltage (DC voltage of −450V and AC voltage (rectangular wave, 1.8 kvpp and 1.6 kHz)) is applied from a development bias applying voltage source S4 to the sleeve 60*a*. The developing sleeve is driven at a peripheral speed 1.2 times as high as that of the photosensitive drum. Thus, the electrostatic latent image on the photosensitive drum 1 is reversal-developed with the toner t2. As the developer, use was made of the toner t2 as shown below.

Toner t2: the mono-component magnetic toner t2 which is a developer was manufactured by binding resin, magnetic material particles and a charge controlling agent being mixed together, and being subjected to the steps of kneading, crushing and classifying, and manufactured by a fluidizing agent or the like being added as an extraneous additive. The magnetic material particles were prescribed by the same weight as the binding resin to thereby manufacture magnetic particles capable of being conveyed by a sufficient magnetic force. Also, the toner t2 is negatively chargeable, and as the mean particle diameter (D4) thereof, use was made of 7 μm.

Comparative Example 5

Magnetic Non-Contact Developing Type and Pole Position Regulation

The present comparative example is a non-contact mono-component developing apparatus 60B basically equal to Comparative Example 4, but changed in the magnetic pole arrangement of the magnet roll.

The present developing apparatus is such that the abutting position of the regulating blade against the sleeve is set to θ=1° (|Brl/|B|=0.99), pulling-out pressure 30 N/m and blade free length 1 mm.

The toner t2 coating the developing sleeve 60*f* is conveyed to a developing region (developing area portion) "a" which is the opposed portion between the photosensitive drum 1 and the sleeve 60*f* by the rotation of the sleeve 60*f*. Also, a development bias voltage (DC voltage of −450V and AC voltage (rectangular wave, 1.8 kvpp and 1.6 kHz)) is applied from a development bias applying voltage source S4 to the sleeve 60*f*. The developing sleeve is driven at a peripheral speed 1.2 times as high as that of the photosensitive drum. Thus, the electrostatic latent image on the photosensitive drum 1 is reversal-developed with the toner t2. As the developer, use was made of the toner t2 as shown below.

Toner t2: it corresponds to that in Comparative Example 4.

Comparative Example 6

Rotary Type Multi-Pole Magnet Roll

Figure 7:
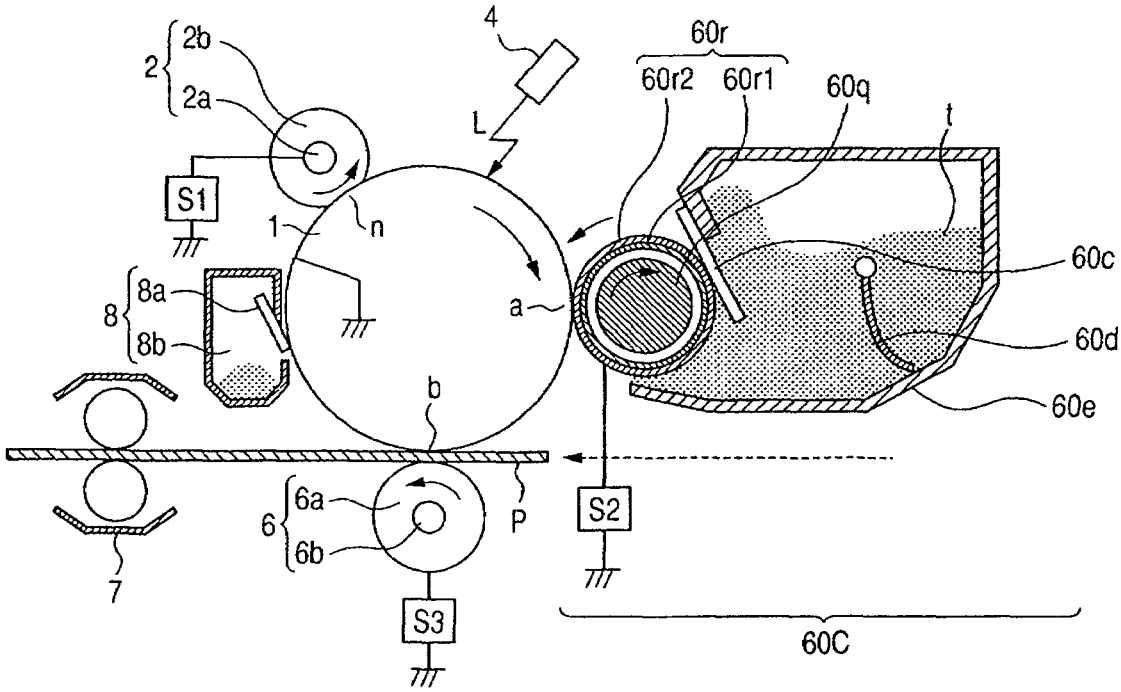
FIG. 7 is a schematic view of Example 1 of an image forming apparatus using Comparative Example 6.

A developing apparatus 60C according to the present comparative example will hereinafter be described. FIG. 7 shows a schematic view of Example 1 of an image forming apparatus using Comparative Example 6.

The reference character 60*r* designates a developing sleeve as a developer carrying and conveying member containing a magnet roll 60*q* therein. The developing sleeve 60*r* is comprised of an aluminum cylinder 60*r*1 and a nonmagnetic electrically conductive elastic layer 60*r*2 formed thereon, and abuts against the photosensitive drum 1 with a constant pressure amount. The pulling-out pressure was 200 N/m.

Method of Manufacturing the Developing Sleeve 60*r* A material was kneaded and extrusion-molded to thereby manufacture the developing sleeve 60*r*. It was adhesively secured onto the aluminum sleeve 60*r*1 with a thickness of 500 μm, and thereafter was polished to thereby manufacture the sleeve. The micro rubber hardness thereof was 94 degrees, and the surface roughness Ra thereof was 1.2 μm.

As the magnet 60*g*, use is made of a multi-pole magnet roll having eight poles magnetized at regular intervals. Magnetic flux density of 300 G is generated at the absolute value of peak density. Also, the magnet roll is rotatively driven at a number of revolutions equal to that of the sleeve in a direction opposite to the rotation direction of the sleeve.

The toner t2 is subjected to layer thickness regulation and charge imparting by the regulating blade 60*c* in the process of being conveyed on the developing sleeve 60*r* while receiving the magnetic force of the magnet roll 60*q*. The reference character 60*d* denotes an agitating member for effecting the circulation of the toner in the developer container 60*e* and sequentially conveying the toner to within a magnetic force reach range around the sleeve.

In the present developing apparatus, in order to obtain a desired toner charging amount and a desired coat amount, a regulating blade 60*c* formed of SK steel having a thickness of 100 μm was set to pulling-out pressure 30 N/m and blade free length 1.2 mm.

The toner t2 coating the developing sleeve 60*r* is conveyed to the developing region (developing area portion) "a" which is the opposed portion between the photosensitive drum 1 and the sleeve 60*r* by the rotation of the sleeve 60*r*. Also, a development bias voltage (DC voltage of −450V) is applied from a development bias applying voltage source S2 to the sleeve 60*r*. The developing sleeve is driven at a peripheral speed 1.2 times as high as that of the photosensitive drum. Thereby, the electrostatic latent image on the photosensitive drum 1 is reversal-developed with the toner t2.

Toner t2: It corresponds to that in Comparative Example 4.

Also, as a construction similar to the present example, there is a developing apparatus disclosed in Japanese Patent Publication No. H04-15949.

Comparative Example 7

Nonmagnetic Contact Developing Type

Figure 8:
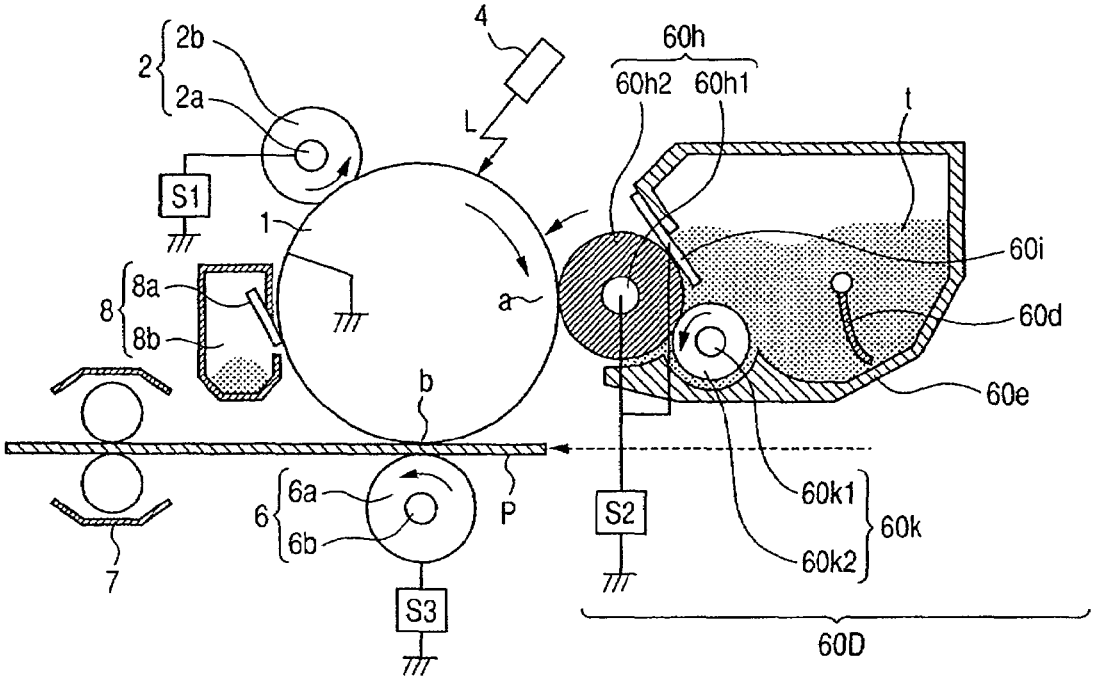
FIG. 8 is a schematic view of Example 1 of an image forming apparatus using Comparative Example 7.

A developing apparatus 60D according to the present comparative example will hereinafter be described. FIG. 8 shows a schematic view of Example 1 of an image forming apparatus using Comparative Example 7.

The reference character 60*h* designates a developing roller comprised of a mandrel 60*h*1 and an electrically conductive elastic layer 60*h*2 formed thereon. Also, the reference numeral 60*k* denotes an elastic roller comprised of a mandrel 60*k*1 and an elastic layer 60*k*2 formed thereon. The developing roller is brought into contact with the photosensitive drum with a constant pressure amount, and the pulling-out pressure thereof was 200 N/m. Also, the elastic roller is fixed relative to the developing roller with a constant shaft interval therebetween, and the pulling-out pressure thereof was 40 N/m. Also, the developing roller is driven at a peripheral speed 1.4 times as high as that of the photosensitive drum, and the elastic roller is rotatively driven at the same number of revolutions as the developing roller so that the surface thereof may be moved in an opposite direction. The rubber hardness of the developing roller was 42 degrees in terms of micro rubber hardness.

A toner t3 is supplied to the elastic roller 60*k* by the agitating member 60*d*. Further, the elastic roller 60*k* supplies the toner t3 to the developing roller 60*h* by the rotation thereof, and the toner t3 is conveyed to the regulating portion. Then, the toner supplied onto the developing roller is regulated to constant frictional charging and a constant coat length by a regulating blade 60*i* formed of phosphor bronze having a thickness of 100 μn and is conveyed to the developing portion. Here, the blade free length of the regulating blade 60*i* was 1 mm, and the pulling-out pressure with the developing roller was 30 N/mm. The toner conveyed on the developing roller is used for the development of the photosensitive drum in the developing portion "a". Also, any toner not used for development but residual on the developing roller is once stripped off by the elastic roller and is again circulated in the container and again coats the developing roller.

As a development bias, a DC voltage of −450V was applied to the mandrel of the developing roller. Also, the elastic roller and the regulating blade were made electrically common to the development bias, and the same development bias potential was applied thereto.

Toner t3: the mono-component nonmagnetic toner t3 which is a developer was manufactured by binding resin, a colorant and a charge controlling agent being mixed together and being subjected to the steps of kneading, crushing and classifying, and was further manufactured by charging particles, a fluidizing agent or the like being added as an extraneous additive. The toner is negatively chargeable, and the mean particle diameter (D4) thereof was 7 μm.

Comparative Example 8

Nonmagnetic Contact Development and Step Blade

A developing apparatus according to the present comparative example basically corresponds to the developing apparatus 60D described in Comparative Example 7, but is provided with a step portion at the abutting position of the regulating blade against the elastic sleeve.

In the present embodiment, the pulling-out pressure at the abutting position of the regulating blade was set to 30 (N/m), the blade step portion length was set to 1 mm, and blade separating portion length was set to 1 mm.

Also, as a construction similar to the present example, there is a developing apparatus disclosed in Japanese Patent Application Laid-open No. 2003-84563.

ABOUT THE SUPERIORITY OF THE PRESENT EMBODIMENT OVER THE CONVENTIONAL ART

Method of Evaluating Each Embodiment and Each Comparative Example

Description will hereinafter be made of image evaluation for examining the differences between the present invention and the comparative examples. Various Image Evaluations in Example 1 of the Image Forming Apparatus a-1) Magnetic Condensation Amount In the magnetic toner, there occurred the phenomenon that during endurance, toner particles are condensed with one another by a magnetic force to thereby reduce the mold releasability and chargeability of the toner. Here, it is called magnetic condensation.

As a method of evaluating the magnetic condensation amount in the present invention, evaluation was effected from the photograph of toner shapes classified by particle sizes obtained by a flow type particle image analyzing apparatus FPIA2100 produced by Sysmex Co., Ltd.

As the measuring method by FPIA2100, 0.1-5 ml of interfacial active agent as a dispersing agent is added to 50-150 ml of measuring solvent, and further a measurement sample picked from the developing sleeve is added by 2-20 mg to thereby provide a suspended solution. The solution having the sample suspended therein is subjected to a dispersing process for about one minute by an ultrasonic disperser and is uniformly dispersed, and thereafter is supplied by about 5 ml to the aforementioned FPIA2100 and measurement is effected. As the reference of evaluation, the rate of toner condensation ranging in the shape of a straight chain in the toner particles classified into particle size classes 4 and 5 (particle number mean diameter of 10-40

μm) in FPIA2100 was found, and judgment was effected from the average value of the present measurement carried out three times.

Large: The existence percentage of magnetic condensation exceeds 20%.

Medium: The existence percentage of magnetic condensation is 10-20%.

Small: The existence percentage of magnetic condensation is 10% or less.

Null: Magnetic condensation does not exist.

Magnetic condensation evaluation was effected after a print test of 5,000 sheets. The print test was effected with sheets of recorded images of a lateral line of image percentage 5% intermittently passed one by one.

a-2) The Factor of Magnetic Condensation

In the present embodiment, the magnetic condensation shows condensation which occurs due to a magnetic field, and which, when it once occurs, does not part even in a situation wherein an external magnetic field does not exist. Generally, it is known that the toner, even if it is nonmagnetic, is reduced in mold releasability by a load received from the developing device during endurance, and a condensed lump is formed in the developing device, whereby a faulty coat such as a streak in a mono-component developing device occurs, but the toner condensation by magnetism dominantly occurs due to magnetic polarization and therefore the toner is condensed in the shape of a straight chain and this can be distinguished from other condensation. Also, it has been found that the magnetic condensation in the present invention not only occurs due only to the magnetic characteristic (residual magnetization) of a magnetic material contained in the toner and an external magnetic field, but is more promoted when pressure is applied thereto from the outside. This is considered to be due to the pressure dependency of the magnetic characteristic in the magnetic material.

b-1) Fog Evaluation

Fog refers to an image fault in which the toner is slightly used for development in a blank portion (unexposed portion) originally not printed and appears like a ground stain.

As regards the fog amount, optical reflectance by a green filter was measured by an optical reflectance measuring machine (TC-6DS produced by Tokyo Denshoku Co., Ltd.), was subtracted from the reflectance of only the recording paper to thereby find a reflectance amount corresponding to the fog, and this was evaluated as the fog amount. As regards the fog amount, ten or more points on the recording paper were measured and the average value thereof was found.

×: the fog amount exceeds 2%.

Δ: the fog amount is 1-2%.

○: the fog amount is 0.5-1%.

¤: the fog amount is less than 0.5%.

Fog evaluation was effected after the printing of 50 sheets and after the printing of 5,000 sheets. The print test was carried out with sheets of recorded images of a lateral line of image percentage 2% intermittently passed one by one. Also, consideration has been given so that when other image fault described hereinafter occurs, measurement may be effected by avoiding that portion and fog can be purely evaluated. Also, the evaluation environment was 32.5° C. and 80% Rh.

c-1) By the print test being repeated, the toner stored in the developing device is decreased and the evaluated image of the lateral line gradually becomes light and in some cases, it breaks. When in the print test, the fault of the image of the lateral line as described previously has occurred, fog evaluation is carried out and thereafter, the developing device is detached from the recording apparatus, and the operation of conveying the toner therein to the developing sleeve or the developing roller by such as shaking the developing device by hand is performed, and the developing device is again mounted on the recording apparatus to thereby effect fog evaluation. Fog evaluation similar to that previously described is effected by these image evaluations, and the worst (greatest) result is used as the fog evaluation of the present evaluation.

c-2) Factor for Fog During Endurance

The supply of the nonmagnetic toner to the developing roller is effected by a sponge-like supplying roller being brought into contact with the developing roller so as to be counter-rotated. Accordingly, by the frictional contact between this developing roller and the supplying roller, the deterioration of the toner occurs remarkably and a reduction in the charge imparting property occurs. Thereby, when the number of printed sheets (particularly of low coverage rate) is increased, the fog amount is increased.

Further, in such a toner supplying mechanism, there is formed an area in which the toner hardly changes places around the developing roller and does not circulate, and the toner little deteriorated exists therein. On the other hand, the circulating toner suffers from predetermined deterioration. When the cartridge is detached and shaken by hand during the exhaustion of the toner, such a toner little deteriorated and the toner suffering from the predetermined deterioration are mixed together in the developer container, that is, the toners greatly differing in the polarity of charge imparting from each other are mixed together and therefore, the fog amount is remarkably increased.

As the reason for such increase in the fog amount, when charge imparting is effected to the toner in such mixing of the toners, the toner not deteriorated becomes higher in the charge imparting property, and the deteriorated toner can hardly be subjected to charge imparting or charges of a polarity opposite to the regular polarity are imparted thereto. By this toner which cannot be subjected to charge imparting or to which the charges of the opposite polarity have been imparted, the fog amount is remarkably increased.

The reason why the toner of the opposite polarity occurs as the fog amount is that the force received in an electric field is in entirely the opposite direction to the toner of the regular polarity, and the toner positively shifts to an ordinary non-print area on the surface of the drum.

In contrast, in the case of the magnetic toner, the toner is conveyed by a magnetic force and therefore, toner deterioration does not remarkably occur, but even if the hand waving of the cartridge is effected immediately before the exhaustion of the toner, the toners greatly differing in polarity from each other are not mixed together and thus, an increase in the fog amount immediately before the exhaustion of the toner can be prevented.

However, it is sometimes the case with the magnetic toner that the aforedescribed magnetic condensation occurs during the latter half of endurance, and the toner reduced in chargeability to a predetermined level or lower by the magnetic condensation lowers the quality of image as fog when it contacts with the photosensitive drum by contact development.

Particularly during the cleaner-less collection in Example 2 of the image forming apparatus, the toner which has become fog is liable to adhere to the charging roller and hinder the charging and cause an image fault. Further, the magnetically condensed toner is difficult to strip off from the charging roller, and when accumulated on the charging roller, it may become entirely incapable of being charged due to the stains of the charging roller and may cause a generally black image.

d-1) Hair Line Uniformity

Image evaluation was effected by the continuity of lengthwise and breadthwise one-dot lines. In the printer according to each example, a 600 dpi laser scanner was used to effect image recording. Image recording was effected with respect to each of a one-dot line parallel to a process progress direction and a one-dot line parallel to the main scanning direction of a laser scanning system. Each hair line having a length of 2 cm is outputted in the apparatus according to each example, and 100 points are extracted at random with respect to each line, and at each point, 200 μm square centering around the line is observed by means of an optical microscope, and a half value width of the density of the line is defined as the line width, and the standard deviation of the line width is calculated with respect to each direction. Then, the line standard deviation in the process direction is defined as ov, and the standard deviation in the laser scanning direction is defined as σh, and the ratio between the two is calculated to thereby obtain a line standard deviation ratio σv/σh. By the use of this value, evaluation was effected on the following reference.

×: the line standard deviation ratio σv/σh is less than 0.7 or exceeds 1.43.

Δ: the line standard deviation ratio σv/σh is 0.7 or greater and less than 0.8 or 1.25 or greater and 1.43 or less.

○: the line standard deviation ratio ov/oh is 0.8 or greater and less than 1.25.

The evaluation was effected during initial 50 sheets and after the printing of 5,000 sheets. The print test was carried out with sheets of recorded images of a lateral line of image percentage 2% intermittently passed one by one.

d-2) The Factor of a Reduction in Hair Line Uniformity

In magnetic non-contact development, there is the problem that the uniformity of the hair line differs between lengthwise and breadthwise. When a magnetic ear develops while moving in parallel to the movement direction of the photosensitive drum, the uniformity of the hair line is good, and is liable to break in a direction orthogonal thereto.

e-1) Image Edge Fault

An image edge fault is the image fault that in an image having great image density, the boundary between the two density differences becomes light.

Image evaluation was effected with a solid black image of 25 mm square printed in a halftone image. In the present evaluation, the halftone image means a spotted pattern in which a dot is recorded with respect to the main scanning direction, whereafter four dots are non-recorded, and a dot is recorded with respect to a direction perpendicular to the main scanning direction, whereafter four dots are non-recorded, and expresses halftone density as a whole. In the halftone and solid black edge portion of the obtained image, on the halftone side of the edge portion, the number of toner particles in one dot of the condensed toner was measured by the use of an optical microscope, and further, with respect to the halftone image portion at a location sufficiently separate from the edge portion, the number of toner particles in one dot was likewise measured. In the measurement of the number of toner particles in one dot, 15 dots were extracted at random in each area, and the average value of the numbers of toner particles was found, and it was defined as the number of toner particles in one dot.

×: the measured number at the edge is 60% or less of the measured number at the location sufficiently separate from the edge portion.

○: the measured number at the edge is greater than 60% of the measured number at the location sufficiently separate from the edge portion.

The evaluation was effected after the printing of initial 100 sheets of images of a lateral line of image percentage 2%.

e-2) Factor for the Occurrence of Image Edge Fault

Figure 9A:
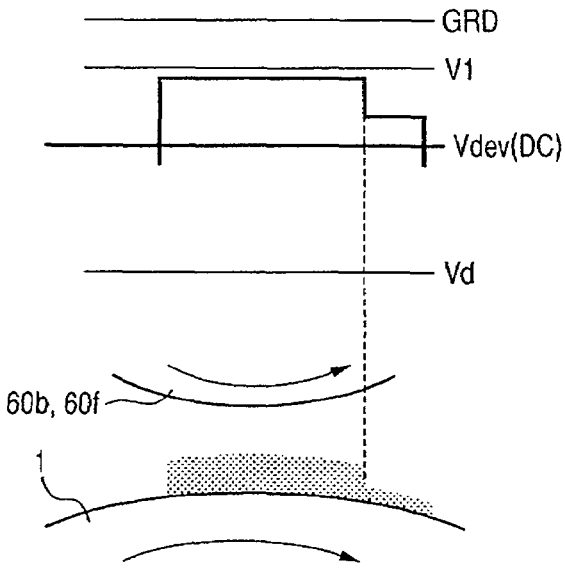
FIGS. 9A and 9B show the mechanism of occurrence of edge fault.
Figure 9B:
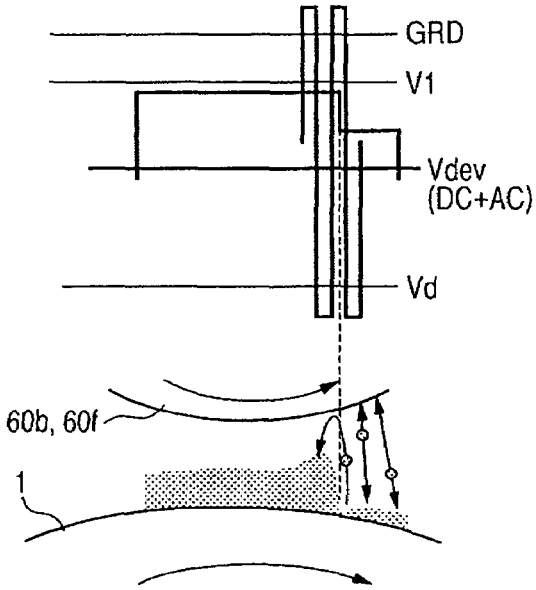

The factor for the image edge fault will now be considered with reference to FIGS. 9A and 9B. When the Vpp value of an AC voltage is made great, the going and coming of the toner in a developed area occur due to the flight of the toner. If at this time, as shown in FIGS. 9A and 9B, there exists a print area which is great in density difference, when the toner reciprocally moves near the boundary line, it is considered that the toner is drawn toward a print area thicker in density and an area in the boundary portion which is thin in density becomes thinner.

f-1) Evaluation of Solid Black Uniformity

In Example 1 of the image forming apparatus, a solid black image generally printed in black is outputted, and optical reflection density is measured by a densitometer RD-1255 produced by Macbeth Co., Inc. Evaluation is effected on the basis of the following reference.

The optical reflection density at the leading edge, center and trailing edge of the solid black image was measured at each three points, i.e., nine points in total, in the longitudinal direction, and evaluation was effected by the difference between the highest density and lowest density among them.

×: 0.2 or greater

Δ: 0.1 or greater and less than 0.2

○: less than 0.1

The evaluation environment was 32.5° C. and 80% Rh. The evaluation was effected with 3 sheets of solid black images outputted after 24 hours has passed after the printing of 50 sheets of images of a lateral line of image percentage 2%. The image evaluation was represented by the greatest value of these three sheets.

f-2) Factor for a Reduction in Solid Black Uniformity

In the developing apparatus of the present invention which is high in developing efficiency and which does not have a stripping-off and supplying roller, it is necessary to quickly supply a sufficient amount of toner onto the developing sleeve on which little or no toner exists after black printing by a magnetic force. Also, when the regulating blade is set to potential higher on the same polarity side as the toner than the developing sleeve by a bias, the toner of the opposite polarity and the toner of low charging amount become liable to be electrically stripped off by the regulating blade, and the toner coat amount after regulation is liable to become non-uniform and therefore, it is necessary to sufficiently supply a toner charged uniformly to a certain degree to the upstream side of the regulating blade.

g-1) Initial Ghost

The supplying and stripping-off property of the developer was evaluated by a development ghost. With the peripheral speed and process speed of the developing roller or the developing sleeve taken into account, a ghost image appearing at the period of the developing roller or the developing sleeve was evaluated. Specifically, the ghost was judged to be an image fault by a ghost in a case where a density difference in a halftone image wherein solid black patch images of 5 mm square and 25 mm square are printed on the leading end of paper which appears at the first period of the developing roller or the developing sleeve can be visually recognized. In the printer according to each example, a 600 dpi laser scanner was used to effect image recording. In the present evaluation, the halftone image means a striped pattern in which one line in the main scanning direction is recorded, whereafter four lines are non-recorded, and expresses halftone density as a whole. Here, the image evaluation was effected on the basis of the following reference.

×: a ghost is recognized in both patches.

Δ: a ghost is recognized in one of the patches.

○: no ghost is recognized in either patch.

The evaluation was effected after the printing of initial 50 sheets of recorded images of a lateral line of image percentage 2%.

g-2) Factor for the Occurrence of Initial Ghost

In the developing apparatus of the present invention which comprises a photosensitive member and a developing sleeve urged against it and which does not have a stripping-off and supplying roller, a fresh toner is supplied to that portion on the elastic sleeve which has consumed the toner during the previous round, and is conveyed to the regulating portion, but during solid black printing, about 90% or more of the toner coat amount is consumed. A toner corresponding to the consumed portion is supplied onto the elastic sleeve in a state the percentage of the newly supplied toner is high relative to the toner not consumed but residual, and is conveyed to the regulating portion. On the other hand, in a portion which has not consumed the toner during the previous round, the toner on the elastic sleeve is intactly returned to the supplying portion and therefore, is supplied onto the elastic sleeve in a state in which the percentage of the newly supplied toner is low relative to the toner not consumed but residual, and is conveyed to the regulating portion. That is, the toner conveyed to the regulating portion causes a difference between the percentages of the fresh and old toners due to the hysteresis of the toner consumption during the previous round. When the change of the places of the upper layer and lower layer in the toner layer, i.e., the stripping-off and supply, cannot be sufficiently effected, a ghost image fault reflecting the hysteresis of the toner consumption during the previous round occurs in a uniform halftone image.

h-1) Endurance Ghost

Like the initial ghost, evaluation was effected by a halftone image in which solid black patch images of 5 mm square and 25 mm square are printed on the leading end of paper. In a case where a density difference appearing at the second and subsequent periods of the developing roller or the developing sleeve can be visually recognized, it was judged as an image fault. The halftone image means a striped pattern in which a 600 dpi line is recorded, whereafter four lines are non-recorded, and expresses halftone density as a whole. Image evaluation was effected on the basis of the following reference.

×: a ghost is recognized in both patches.

Δ: a ghost is recognized in one of the patches.

○: no ghost is recognized in either patch.

The evaluation was effected after the intermittent printing of 5,000 sheets of recorded images of a lateral line of image percentage 2%.

h-2) Factor for the Occurrence of Endurance Ghost

Like the initial ghost, in the developing apparatus of the present invention which does not have a stripping-off and supplying roller, a difference occurs between the percentages of fresh and old toners in the regulating portion, in a portion of the elastic sleeve which has consumed the toner during the previous round and a portion on which the toner is not consumed but is residual. Here, in the case of a toner which has been reduced in mold releasability and chargeability by endurance, it is difficult for the change of places of the upper layer and lower layer in the toner layer to be sufficiently effected and moreover, it is difficult for the newly supplied fresh toner to rise a charging amount equal to that of the old toner so far present on the sleeve and therefore, a ghost image which has occurred during only one round of the developing sleeve at the initial stage may sometimes repetitively occur on a halftone image over two to five rounds of the developing sleeve in the latter half of endurance.

i-1) Ripple Image Fault

Image evaluation was effected by an image fault in solid white and a halftone image which occurs at the period of the developing sleeve or the developing roller. The developing period was accurately calculated with the process speed and the peripheral speed ratio between the photosensitive drum and the developing sleeve taken into account, and an image fault at the same period was extracted and evaluated.

The size of the image fault was a minor axis length of the order of 2-10 mm and a major axis length of the order of 3-100 mm, and the partial optical density thereof was about 0.2 to about 1, and this image fault was evaluated distinctively from the other image faults. The evaluation can be clearly discriminated by the presence or absence of fault, and was effected on the basis of the following reference.

×: a ripple-shaped image fault is present on the white ground.

Δ: a ripple-shaped image fault is present in the halftone image.

○: No ripple-shaped image fault is present.

The evaluation environment was 15° C. and 10% Rh. The evaluation was effected with 3 sheets of solid white images and a halftone image outputted after the printing of 100 sheets of recorded images of a lateral line of image percentage 5%.

i-2) Factor for the Occurrence of Ripple Image Fault

In a solid white image, the toner is not consumed and therefore, a great amount of toner returns to the supplying portion. If at that time, the change of places of the new and old toners cannot be sufficiently effected, unevenness becomes liable to occur to the distribution of the specific charge of the toner coat layer or the thickness of the coat layer after the toner has passed the regulating blade. When the unevenness of the distribution of the specific charge has occurred, there is produced a toner of which the specific charge is locally high beyond a proper value. Such a toner is high in its force adhering to the surface of the sleeve and therefore, it becomes difficult to change places. That is, this is a phenomenon which becomes liable to occur due to solid white being continuously printed. When a fresh toner is supplied to a portion in which thin toner of high specific charge has been formed, the toner supplied to that portion is reduced in the charge imparting property of the sleeve surface to the toner, and cannot obtain a proper specific charge. As the result, a toner low in specific charge or having charges of the opposite polarity is produced in a constant amount on the surface of the toner coat layer and therefore, when development is effected with the sleeve brought into contact with the drum, the toner contacts with the surface of the drum to thereby adhere to the non-print portion of the drum, and a stain-like image fault occurs.

This phenomenon is liable to occur under a low-humidity environment in which the toner charging amount is high, and particularly in a cleaner-less system which is Example 2 of the image forming apparatus, when a ripple-shaped image fault occurs, the stains of the transfer roller are caused and charging becomes entirely impossible due to the stains of the charging roller, thus resulting in a generally black image, and there is the possibility that a transfer material twines around the fixing device to thereby cause trouble to the apparatus. Therefore, in the cleaner-less system, it is very important to suppress the ripple-shaped image fault.

Description will now be made of the various image evaluations by Example 2 of the image forming apparatus which is a cleaner-less system.

j-1) Cleaner-Less Toner Collectability

The image recording apparatus is stopped during the printing of an evaluation pattern in which a solid black image of about 30-50 mm has been printed on the leading end of a recorded image, whereafter a solid white image has been disposed. It is to be understood that the timing of stoppage is a point of time at which the central position of a solid black image on the leading end has just arrived at the developing area. Then, it becomes possible to measure the toner adhering to the surface of the photosensitive drum before and after development as reflectance, and find the ratio thereof to thereby effect the evaluation of the collection efficiency of the toner. Actually, the toner on the drum is once transferred to a transparent tape, and the tape having the toner adhering thereto is stuck on recording paper or the like, and as in fog measurement, the net reflectance of the toner is measured from on the tape.

×: the collection rate is less than 30%.

Δ: the collection rate is 30% or greater and less than 50%.

○: the collection rate is 50% or greater.

The evaluation was effected during the printing of initial 100 sheets of recorded images of a lateral line of image percentage 2%.

j-2) Factor for Reduction in Cleaner-Less Toner Collectability

Figure 10:
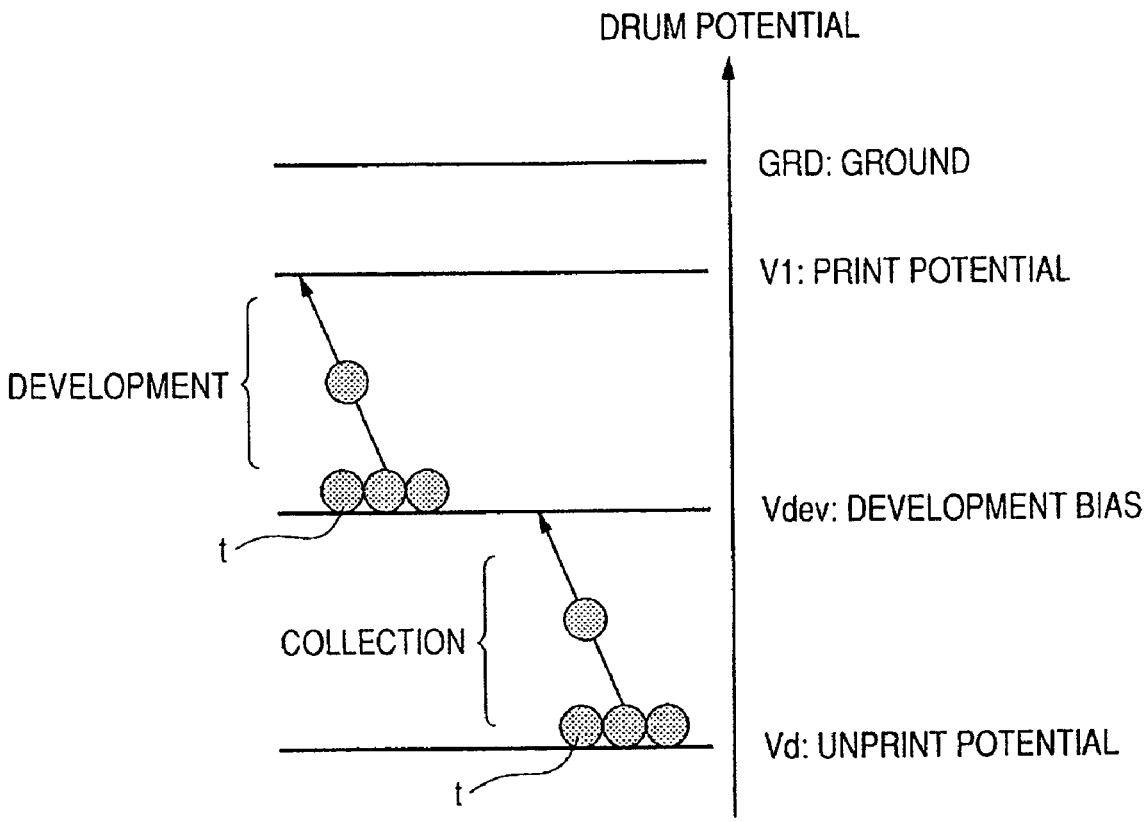
FIG. 10 shows the mechanism of cleaning simultaneous with developing.

The most different point in Example 2 of the image forming apparatus is that the drum cleaner is disused and any untransferred residual toner is collected in the developing device and recycled. In the present invention, the developer carrying member is urged against the photosensitive drum with predetermined pressure, and has a development bias applied thereto, and develops (visualizes an electrostatic latent image formed on the surface of the drum with a toner and at the same time, collects the untransferred residual toner on a non-exposed portion (white ground portion). As shown in FIG. 10, by the utilization of the potential difference between the development bias and the potential (V1 in the case of solid black) of a print portion, the toner is shifted from the toner carrying member to the photosensitive drum to thereby effect reversal development, and by the utilization of the potential difference between the development bias and the potential (Vd) of a non-print portion, the return toner on the photosensitive drum is shifted onto the toner carrying member.

Further, the toner carrying member is urged against and brought into contact with the drum, whereby the distance between the drum and the toner carrying member becomes small and the intensity of an electric field is increased to thereby improve collection simultaneous with development.

In addition, the toner carrying member is urged against and brought into contact with the drum to thereby reliably effect the development and collection by the electric field by an increase in the developing nip and also, promote the returned toner being made negative by the toner carrying member and effect the physical loosening of the returned toner, thus improving collectability.

On the other hand, when the photosensitive drum and the toner carrying member are opposed to each other in a non-contact state, the distance therebetween is great and therefore, a magnetic collecting force and an electrical collecting force become weak. Thus, the collection rate is lowered.

Also, when the toner carrying member is urged against and in contact with the photosensitive drum, the attraction and van der Waals force working due to objects contacting with each other work substantially in the same order of force between the drum and the toner, between the toner and the toner carrying member and between the toner and the toner and therefore, this does not become a factor for a reduction in collectability. However, when the drum and the toner carrying member are in non-contact with each other, these forces work only between the drum and the returned toner and become a hindrance to strip off the toner from the drum, and collectability is remarkably reduced.

k-1) Halftone Image Fault

Image evaluation was effected from the number of image faults when halftone images were outputted. In the printer according to each example, a 600 dpi laser scanner was used to effect image recording. In the present evaluation, the halftone image means a striped pattern in which one line in the main scanning direction is recorded, whereafter two lines are non-recorded, and expresses the density of halftone as a whole.

Particularly, in the present invention, importance was attached to the uniformity of the halftone image, and the fault of a white spot or a black spot of 0.3 mm or greater was evaluated.

×: more than five white spots or black spots having a diameter of 0.3 mm or greater exist in a halftone image.

Δ: one to five white spots or black spots having a diameter of 0.3 mm or greater exist in a halftone image.

○: no white spot or black spot having a diameter of 0.3 mm or greater exists in a halftone image.

The evaluation was effected after the print test of 5,000 sheets of recorded images of a lateral line of image percentage 2%.

k-2) Factor for the Occurrence of Halftone Image Fault

The coat layer is disturbed by the occurrence of the condensed lump of the toner or the mixing of a foreign substance with the toner and therefore, a fault of a size nearly equal to that of the condensed lump or the foreign substance occurs in a halftone image.

In the cleaner-less system which is Example 2 of the image forming apparatus, the collection of the return toner is done and therefore, a halftone image fault is liable to occur. Particularly, in a case where as in the nonmagnetic contact development, the supplying roller is in contact with the developing roller and is counter-rotated, physical stress becomes high in the contact portion. When such a construction is used, a condensed lump is liable to be formed by the returned toner or the deteriorated toner, and a halftone image fault is liable to occur remarkably.

l-1) Halftone Image Fault by Paper Dust

In Example 2 of the image forming apparatus, paper dust (paper fiber) sometimes adhere from recording paper to the photosensitive drum, and is introduced into the developing device via charging. When the paper dust is introduced into the developing device, the paper dust sometimes gets tangled with the elastic roller or the like to thereby cause an image fault extending in the process progress direction of the period of the elastic roller. This was evaluated distinctively from the halftone image fault mentioned under item k).

A spot having a minor axis length of 0.3 mm or greater and a major axis length of 2 mm or greater was defined as an image fault, and the number of faults in the surface was evaluated on the basis of the following reference.

×: more than five faults exist in a halftone image.

Δ: one to five faults exist in a halftone image.

○: no fault exists in a halftone image.

The evaluation was effected after the print test of 5,000 sheets of recorded images of a lateral line of image percentage 2%.

l-2) Factor for the Occurrence of Halftone Image Fault by Paper Dust

When paper dust contained in the return toner gets mixed with the developing device, the paper dust adheres to the sponge-like supplying roller for supplying the toner to the developing roller to thereby cause a reduction in the stripping-off and supplying property. When the paper dust is accumulated between the supplying rollers, the toner layer on the developing roller is disturbed to thereby cause a fault extending in the process direction.

m-1) Hindrance by Solid Black Image Fault

Image evaluation was effected from the number of image faults with solid black images outputted. Particularly in the present invention, faults of 0.3 mm or greater were evaluated.

×: more than 50 white spots having a diameter of 0.3 mm or greater exist in a solid black image.

Δ: 10 to 50 white spots having a diameter of 0.3 mm or greater exist in a solid black image.

○: less than 10 white spots having a diameter of 0.3 mm or greater exist in a solid black image.

The evaluation environment was 32.5° C. and 80% Rh. The evaluation was effected with 3 sheets of solid black images outputted after 24 hours has passed after the printing of 100 sheets of recorded images of a lateral line of image percentage 5%. The image evaluation was represented by the page of these three sheets in which the number of faults was greatest.

m-2) Factor for the Occurrence of Solid Black Image Fault

Figure 11B:
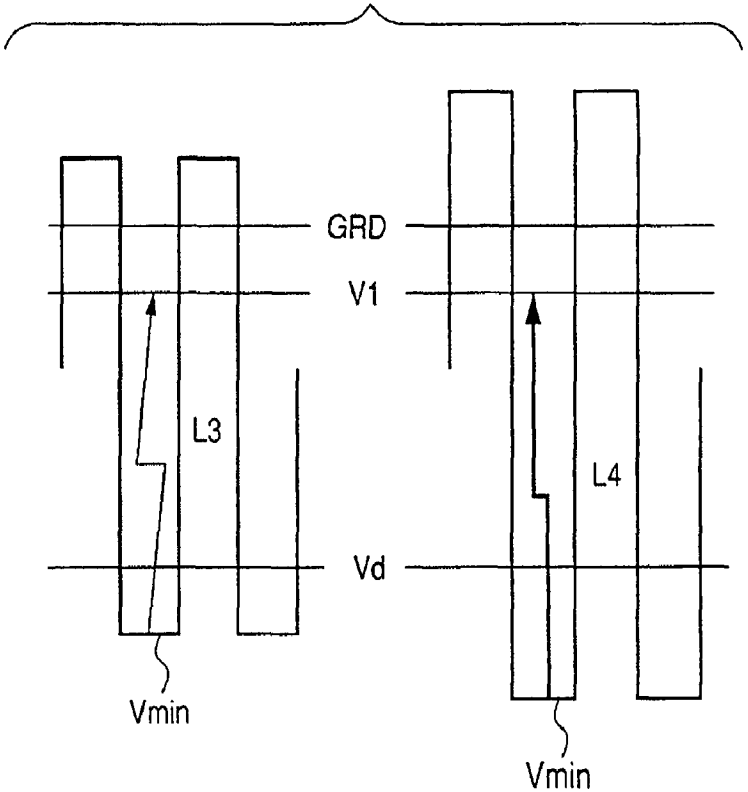
FIGS. 11A, 11B and 11C show the mechanism of occurrence of a solid black image fault.
Figure 11A:
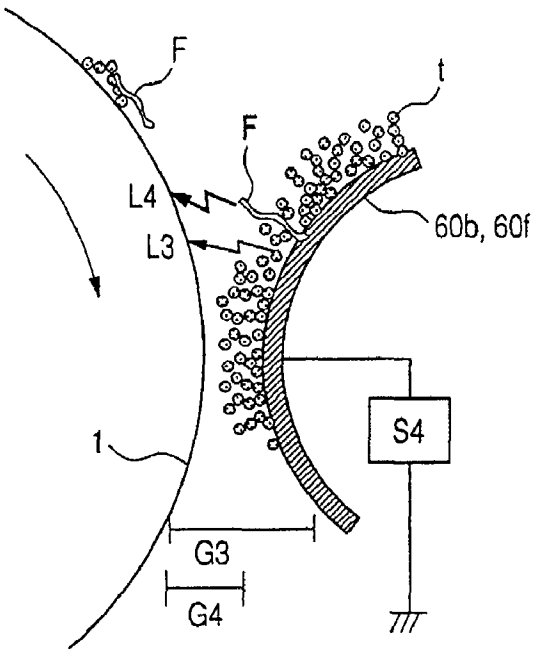

As shown in FIGS. 11A and 11B, when during the application of an AC voltage, a solid white image is being developed, the difference between the surface potential (dark potential Vd) of the photosensitive drum and the maximum value (Vmax) of the development bias voltage becomes maximum electric field intensity, and there is brought about a state in which leak L3 is liable to occur.

When the leak L3 occurs, the electrostatic latent image on the photosensitive drum 1 in the corresponding portion is disturbed with a result that part of the potential (dark potential Vd) of the solid white portion on the photosensitive drum 1 approximates to or exceeds light potential (V1) due to the leak and therefore, the toner t onto the photosensitive drum 1 by reversal development shifts, and as the result, the toner adheres to the said portion of the photosensitive drum 1 and a black spot image is considered to occur.

When the leak occurs, there is formed a portion charged with the value of Vmax on the photosensitive drum irrespective of the intensity of the electric field. If Vmax is great, the contrast (|Vmax-Vdc|) with the DC value Vdc of the development bias is great and therefore, the shift amount of the toner increases and is very conspicuous on the image.

Figure 11C:
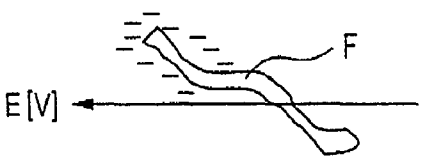

Further, when the paper dust contained in the return toner comes to the developing area together with the toner (FIG. 11A), leak occurs along the paper dust. When as shown in FIG. 11A, the paper dust F has come to the developing area, the gap with respect to the drum becomes G4 smaller than G3. At this time, the localized intensity of the electric field applied to the paper dust increases (the right in FIG. 11B), and leak becomes liable-to occur. Also, under a high-temperature and high-humidity environment, the paper dust adsorbs much moisture and resistance is reduced. When at this time, as shown in FIG. 11C, an external electric field E is applied, the deviation of charges occurs and the charge amount increases at the tip end of the paper dust and becomes more liable to leak. From this, it is considered that in the cleaner-less system, as compared with a system with a cleaner, leak becomes liable to occur.

TABLE 1

| Embodiments and Comparative Examples | blade abutting portion position \|Br\|/\|B\| | blade separating portion position \|Br\|/\|B\| | blade step portion | blade bias | Embodiment 1 a) magnetic condensation amount | Embodiment 1 b) high-temperature high-humidity environment fog | Embodiment 1 c) fog during exhaustion of toner |
|---|---|---|---|---|---|---|---|
| Embodiment 1 magnetic contact, elastic sleeve | inter-pole 0.03 | pole position 0.96 | present | present | small | ¤→○ | ○ |
| Embodiment 2 magnetic contact, elastic sleeve | pole position 0.80 | pole position 0.77 | ↑ | ↑ | medium | ○→○ | ○ |
| Embodiment 3 magnetic contact, elastic sleeve | inter-pole 0.03 | pole position 0.96 | ↑ | absent | small | ○→X | Δ |
| Comparative Example 1 magnetic contact, elastic sleeve | inter-pole 0.40 | inter-pole 0.33 | ↑ | present | small | ○→○ | ○ |
| Comparative Example 2 magnetic contact, elastic sleeve | pole position 0.84 | inter-pole 0.16 | ↑ | ↑ | great | ○→X | ○ |

TABLE 1-continued

| | | | | | | | |
|---|---|---|---|---|---|---|---|
| Comparative Example 3 magnetic contact, elastic sleeve | inter-pole 0.03 | pole position 0.99 | absent | present | medium | Δ→Δ | Δ |
| Comparative Example 4 magnetic non-contact, rigid sleeve | inter-pole 0.03 | inter-pole 0.33 | ↑ | absent | small | ○→○ | Δ |
| Comparative Example 5 magnetic non-contact, rigid sleeve | pole position 0.99 | pole position 0.94 | ↑ | ↑ | medium | ○→○ | Δ |
| Comparative Example 6 magnetic contact, multi-pole magnet | | — | ↑ | ↑ | medium | ○→Δ | Δ |
| Comparative Example 7 nonmagnetic contact, elastic sleeve | — | — | ↑ | present | null | ¤→Δ | X |
| Comparative Example 8 nonmagnetic contact, elastic sleeve | — | — | present | ↑ | null | ¤→○ | X |

| | Embodiment 1 | | | | | |
|---|---|---|---|---|---|---|
| Embodiments and Comparative Examples | d) hair line uniformity | e) image edge fault | f) solid black uniformity | g) initial ghost | h) endurance ghost | i) low-humidity environment ripple image fault |
| Embodiment 1 magnetic contact, elastic sleeve | ○→○ | ○ | ○ | ○ | ○ | ○ |
| Embodiment 2 magnetic contact, elastic sleeve | ○→Δ | ○ | ○ | Δ | Δ | Δ |
| Embodiment 3 magnetic contact, elastic sleeve | ○→○ | ○ | ○ | ○ | Δ | ○ |
| Comparative Example 1 magnetic contact, elastic sleeve | ○→○ | ○ | X | X | ○ | ○ |
| Comparative Example 2 magnetic contact, elastic sleeve | ○→Δ | ○ | ○ | Δ | X | Δ |
| Comparative Example 3 magnetic contact, elastic sleeve | ○→Δ | ○ | ○ | ○ | Δ | X |
| Comparative Example 4 magnetic non-contact, rigid sleeve | X→X | X | ○ | ○ | Δ | ○ |
| Comparative Example 5 magnetic non-contact, rigid sleeve | X→X | X | ○ | Δ | X | Δ |
| Comparative Example 6 magnetic contact, multi-pole magnet | X→X | ○ | Δ | Δ | Δ | X |
| Comparative Example 7 nonmagnetic contact, elastic sleeve | ○→○ | ○ | ○ | ○ | ○ | ○ |
| Comparative Example 8 nonmagnetic contact, elastic sleeve | ○→○ | ○ | ○ | ○ | ○ | ○ |

TABLE 2

| Embodiments | | | | | Embodiment 2 | | | |
|---|---|---|---|---|---|---|---|---|
| and Comparative Examples | blade abutting portion position \|Br\|/\|B\| | blade separating portion position \|Br\|/\|B\| | blade step portion | blade bias | j) cleaner-less collectability | k) halftone image fault | l) halftone image fault due to paper dust | m) solid black image fault |
| Embodiment 1 magnetic contact, elastic sleeve | inter-pole 0.03 | pole position 0.96 | present | present | ○ | ○ | ○ | ○ |
| Embodiment 2 magnetic contact, elastic sleeve | pole position 0.80 | pole position 0.77 | ↑ | ↑ | ○ | ○ | ○ | ○ |
| Embodiment 3 magnetic contact, elastic sleeve | inter-pole 0.03 | pole position 0.96 | ↑ | absent | ○ | ○ | ○ | ○ |

TABLE 2-continued

| Embodiments and Comparative Examples | blade abutting portion position \|Br\|/\|B\| | blade separating portion position \|Br\|/\|B\| | blade step portion | blade bias | Embodiment 2 j) cleaner-less collectability | k) halftone image fault | l) halftone image fault due to paper dust | m) solid black image fault |
|---|---|---|---|---|---|---|---|---|
| Comparative Example 1 magnetic contact, elastic sleeve | inter-pole 0.40 | inter-pole 0.33 | ↑ | present | ○ | ○ | ○ | ○ |
| Comparative Example 2 magnetic contact, elastic sleeve | pole position 0.84 | inter-pole 0.16 | ↑ | ↑ | ○ | ○ | Δ | ○ |
| Comparative Example 3 magnetic contact, elastic sleeve | inter-pole 0.03 | pole position 0.72 | absent | present | ○ | ○ | ○ | ○ |
| Comparative Example 4 magnetic non-contact, rigid sleeve | inter-pole 0.03 | inter-pole 0.33 | ↑ | absent | X | ○ | ○ | X |
| Comparative Example 5 magnetic non-contact, rigid sleeve | pole position 0.99 | pole position 0.94 | ↑ | ↑ | X | ○ | Δ | X |
| Comparative Example 6 magnetic contact, multi-pole magnet | — | — | ↑ | ↑ | Δ | ○ | ○ | ○ |
| Comparative Example 7 nonmagnetic contact, elastic sleeve | — | — | ↑ | present | ○ | X | X | ○ |
| Comparative Example 8 nonmagnetic contact, elastic sleeve | — | — | present | ↑ | ○ | X | X | ○ |

(Superiority Over the Conventional Art)

First, the superiority of the magnetic contact developing type in the present invention over the magnetic non-contact developing type which is the conventional art and comparative examples corresponding to the nonmagnetic contact developing type will be shown (Table 1).

(1-1) Comparison with the Magnetic Non-Contact Developing Type (Comparative Examples 4 and 5)

The developing device according to Comparative Example 4 which is the magnetic non-contact developing type causes a reduction in hair line uniformity and image edge fault in Example 1 of the image forming apparatus. This is because Comparative Example 4 forms a magnetic ear by a magnetic field and develops, whereby depending on whether the direction of development is the movement direction of the ear, a difference becomes liable to occur to the uniformity of the hair line during development. Also, the distance between the sleeve and the drum is great and due to the AC electric field, the toner flies irrespective of the image portion or the non-image portion with a result that the toner is swept up to the edge portion of the image and a density difference occurs between the edge portion and the central portion.

Also, in the evaluation of the cleaner-less collection by Example 2 of the image forming apparatus in Table 1, it will be seen that the collectability of the toner is remarkably reduced. This is considered to be because due to the non-contact developing type, the force with which the toner contacting with the drum is stripped off is great, and the force working for collection is insufficient.

Also, a solid black image fault occurred. It has been confirmed that in an ordinary state, the leak due to the development bias does not occur, but yet when under a high-temperature and high-humidity environment, a foreign substance such as paper dust comes into between the developing sleeve and the drum, the leak occurs with it as a route.

(1-2) Comparison with the Nonmagnetic Contact Developing Type (Comparative Example 7)

Description will now be made of the developing device according to Comparative Example 7 which is the nonmagnetic contact developing type. In Example 1 of the image forming apparatus, there occurs the endurance deterioration of fog. This is attributable to the fact that due to the supplying and stripping operation by the elastic roller, the toner receives mechanical stress and the toner charging characteristic is reduced. At this time, a reduction in density due to the deterioration of the toner is also seen. Further, when the toner in the developing device is decreased, the above-mentioned deteriorated toner and the undeteriorated toner which has not been concerned in the circulation are mixed together and the toner charging characteristic is remarkably reduced to thereby cause vehement fog. On the other hand, in the evaluation of the cleaner-less collection by Example 2 of the image forming apparatus, the collectability is good, but there occurs a halftone image fault which seems to be attributable to the elastic roller. In Example 2 of the image forming apparatus, besides the mechanical stress by the elastic roller, the toner once used for development returns into the developing device via the transferring and charging steps, whereby more of deteriorated toner is produced, and the toner forms a condensed lump to thereby cause a fault to the halftone image. Further, the evil by the paper dust mixed with the developing device is also great, and such paper dust adheres to the surface of the elastic roller to thereby cause a periodic image fault.

(1-3) The Effect of the Present Invention Advantageous over the Conventional Art (1-3a) Example 1 of the Image Forming Apparatus On the other hand, the developing device of Embodiment 1 can constitute a good image forming apparatus in both of Examples 1 and 2 of the image forming apparatus. Now, comparison will be made with respect to Example 1 of the image forming apparatus.

In the developing device of Embodiment 1, there was no difference due to the direction in the hair line uniformity which previously posed a problem in Comparative Example 4, and uniform image reproduction was possible. In the magnetic force in the developing portion, the two were of substantially the same degree, but by the regulating blade being provided with a step portion, the stripping-off of the toner from the developing sleeve was improved, and by the regulating blade being provided with a separating portion, and by the position thereof being kept proper and by the DC bias applied to the developing sleeve, the formation of a long magnetic ear was also suppressed in a similar magnetic field, and it became possible to eliminate the influence of the magnetic ear during development. Also, there was no image edge fault and uniform image reproduction was possible. This is because the elastic sleeve is brought into contact with the photosensitive drum to thereby provide DC development, whereby the toner is prevented from being swept up by the reciprocal movement thereof.

Also, in the present embodiment, there was not seen the endurance deterioration of fog which posed a problem in Comparative Example 7. In Comparative Example 7, use is made of an elastic roller for stripping off and supplying the toner and therefore, locally high pressure is produced from the conveyance by the elastic roller. On the other hand, in the present example, the stripping-off and supplying roller is not used, but the conveyance of the toner is effected by a magnetic force. The conveyance by the magnetic force reduces the mechanical stress to the toner and enables the stripping-off and supply of the toner on the developing sleeve to be effected and further, as compared with the elastic roller, the force acts in non-contact and therefore, this conveyance is excellent in the range and efficiency of circulating the toner. Consequently, no stress is exerted on the toner, and the stripping-off and supply of the toner can be effected and such an evil as a ghost is null, and it becomes possible to effect the conveyance of the toner. Also, any condensed lump of toner is not produced.

3b) Example 2 of the Image Forming Apparatus

Next, evaluation in Example 2 of the image forming apparatus is effected with respect to Embodiment 1. The elastic sleeve and the photosensitive drum are disposed in contact with each other and therefore, the distance between the elastic sleeve and the photosensitive drum becomes close, whereby the area in which and the intensity with which the electric field or the magnetic field works increases, and the collectability of the untransferred residual toner adhering to the unexposed portion of the photosensitive drum is considered to have been improved, and the collectability of the toner was good and further, the halftone image fault and the influence of the paper dust seen in Comparative Example 6 were not seen because the conveyance by the magnetic force with the elastic roller eliminated was effected. The solid black image fault seen in Comparative Example 4 was neither seen. A great electric field is applied as the electric field, and this is considered to be because there does not occur such a great potential difference as causes discharge.

(1-4) Comparison with Comparative Example 6

Also, as in Comparative Example 6, the supply and stripping-pff by a rotary magnetic force using a multi-pole magnet is conceivable, but this resulted in the inferiority in ghost performance. Also, the magnetic force vibrates in the regulating portion and the developing portion and therefore, the fog and cleaner-less collectability resulted somewhat badly. The magnetic force is more or less weakened by the multi-pole magnet, but the influence of the magnetic ear still remains, and the present example is inferior in hair line uniformity. On the other hand, owing to the contact DC development, the image edge fault is improved by the contact with the photosensitive member.

(1-5) Comparison with Comparative Example 8

In Comparative Example 8, the shape of the blade is changed as compared with Comparative Example 7, and a step portion is provided. Comparative Example 8 is directed to obtain uniform abutting pressure over the longitudinal direction of the regulating blade and at the same time, regulate the flow of the toner upstream of the regulating blade with respect to the rotation direction of the developing roller and effect uniform toner supply to thereby reduce the abutting pressure and achieve uniform thin layer formation, but on the stripping-off and supplying member, the toner still receives great mechanical stress. Accordingly, fog occurred in the latter half of endurance, and when the toner in the developing device was decreased, the toner deteriorated chiefly in the stripping-off and supplying member and the undeteriorated toner not concerned in the circulation were mixed together to thereby remarkably reduce the toner charging characteristic and therefore, vehement fog occurred. Likewise, in the evaluation of the cleaner-less collection by Example 2 of the image forming apparatus, collectability was good, but a halftone image fault which seemed to be attributable to the elastic roller occurred, and the toner further deteriorated by once passing through the developing, transferring and charging steps was returned into the developing device, whereby a greater deal of deteriorated toner was liable to be produced, and the toner formed a condensed lump to thereby cause a fault to the halftone image. Further, the evil by the paper dust mixed with the developing device was great, and equally to Comparative Example 7, the paper dust adhered to the surface of the elastic roller to thereby cause a periodic image fault.

(1-6) Example 1 of the Image Forming Apparatus Will Now be Described in Detail.

6a) Evaluation of Magnetic Condensation

When the magnetic condensation amount was evaluated in conformity to the aforedescribed evaluation conditions, in Embodiments 1 and 3, the magnetic condensation amount was small, whereas in Embodiment 2 and Comparative Example 2, the magnetic condensation amount was somewhat increased. This seems to be due to the influence of the diametral magnetic field Br at the blade abutting position, and when the magnetic field Br is strengthened while abutting pressure is given to the magnetic toner, it seems that the magnetization of the toner is promoted and magnetic condensation becomes liable to occur. Particularly in Comparative Example 2, the magnetic condensation amount was increased, and this seems to be because the magnetic field in the separating portion was weak and therefore the toner circulation from the step portion which will be described later to the separating portion was insufficient.

Also, in Comparative Example 3, the blade abutted between the poles, nevertheless the magnetic condensation was increased. This seems to be because at the blade abutting position, the blade does not have the step portion and therefore, the circulation of the regulated and separated toner became insufficient and the toner stagnated upstream of the regulating portion, and the opportunity for the toner to receive magnetism and stress increased.

In Comparative Examples 4 and 5, the blade pressure was low and therefore, the magnetic condensation amount was rather small. However, in Comparative Example 5 wherein the regulating blade abuts at the pole position, the magnetic condensation was somewhat increased.

On the other hand, in Comparative Example 6, it seems that because of the rotary magnet, the toner present at the magnetic pole position passed the regulating portion, whereby the magnetic condensation amount was increased.

In Comparative Examples 6, 7 and 8, a nonmagnetic toner is used, and there is no influence of magnetization and therefore, under similar evaluation conditions, the magnetic condensation was not seen at all.

6b and 6c) Evaluation of Fog

Description will now be made of the result of the evaluation of fog. The fog in Embodiment 1 was at a good level both during the endurance of 5,000 sheets under a high-temperature and high-humidity environment and before and after the exhaustion of the toner.

In Embodiment 1, the toner of a low charging amount on the developing sleeve was effectively stripped off by the step portion of the regulating blade to thereby obtain a thin toner layer stable with a high charging amount and also, the diametral magnetic field Br in the abutting portion of the regulating blade was made small to thereby reduce the stress and at the same time, the applied magnetic field, thus suppressing magnetic condensation. Further, the magnetic field Br in the separating portion was made great to thereby generate a strong magnetic field travelling from the abutting portion toward the separating portion and thereby promote the circulation of the toner, thus preventing the toner near the abutting portion from concentratively receiving stress and being extremely deteriorated. Also, a DC bias of −100V of the same polarity side as the toner is applied to the regulating blade with the developing sleeve as the reference, and in the abutting portion, the charge imparting to the toner by a DC electric field is promoted. Further, in the step portion, the toner charged to the opposite polarity and the toner of a low charging amount are stripped off from the developing sleeve by the DC electric field, whereby even in the case of a toner of low chargeability after the endurance, the toner on the developing sleeve after having passed the regulating blade can be brought to a uniform and proper charging amount. Accordingly, the toner charging amount when the magnetic condensation during the endurance occurred could be improved, and the fog was stable and good. Also, even during the exhaustion of the toner, mechanical stress was little because of the absence of the stripping-off and supplying roller or the like in the nonmagnetic developing method, and the sudden aggravation of the fog by the mixing of the deteriorated toner and the undeteriorated toner at the last stage of the endurance did not occur.

Embodiments 2 and 3 are similar in basic construction to Embodiment 1 and therefore, both of them were good in the fog at the initial stage. Also, during the endurance, in Embodiment 2, the magnetic condensation was increased, whereas the fog was good. This is considered to be because in Embodiment 2 a blade bias was applied to the developing sleeve on the same polarity side as the toner (−100V), and even in the case of the toner more or less magnetically condensed by the increase in the toner charging amount by the electric field and the stripping-off of the toner charged to the opposite polarity, a toner of a high charging amount could be applied as a coat to thereby suppress the fog.

On the other hand, in Embodiment 3, in spite of the magnetic condensation being little, the fog was somewhat increased. This is considered to be because in Embodiment 3, the blade bias is made equal in potential to the developing sleeve and therefore, the charging amount in the blade abutting portion and the stripping-off on the blade step portion weakened and in the case of the magnetically condensed toner, a toner of a relatively low charging amount became liable to be applied as a coat and the fog was somewhat increased.

Further, Comparative Example 2 was good in fog at the initial stage, but the occurrence of the magnetic condensation amount during the endurance was great and therefore, in spite of the blade bias being applied, the fog was aggravated by the endurance.

In Comparative Examples 4 and 5 wherein use is made of magnetic mono-component development using a non-contact rigid sleeve, the fog was good both at the early stage and after the endurance. Here, in view of the fact that in Comparative Example 5, the fog was good in spite of pole position regulation being used and a considerable amount of magnetic condensation being caused by the endurance, when the developing sleeve and the photosensitive drum are in non-contact with each other, the flying property of the toner is suppressed even if magnetic condensation occurs to the toner due to the endurance, and therefore it seems that it is difficult for the fog to be aggravated. On the other hand, in contact development, when the magnetic condensation occurs, the toner is liable to adhere to the photosensitive drum, and is considered to be liable to become an image fault as fog.

In Comparative Example 6 using a multi-pole magnet, the pole position is rotated and therefore, when a strong magnetic pole passed, the toner present near the pressure contact portion is liable to cause magnetic condensation, and the fog was increased by the endurance.

In Comparative Examples 7 and 8 using a nonmagnetic toner, independently of magnetic condensation, the toner is deteriorated on the stripping-off and supplying roller by mechanical stress and therefore, during the exhaustion of the toner, the fog was suddenly aggravated when the deteriorated toner and the undeteriorated toner so far relatively not circulated were mixed together.

6d) Evaluation of Hair Line Uniformity

Description will now be made of the result of the evaluation of hair line uniformity. In the construction of the present invention, it is possible to relatively shorten the magnetic ear in the developing portion and therefore, at the initial stage, good uniformity could be obtained in Embodiments 1 to 3 and Comparative Examples 1 and 2.

On the other hand, during the endurance, like the fog, the hair line uniformity is also affected by the magnetic condensation amount, and when the magnetic condensation occurred in a great deal, the magnetic ear became long in the developing portion, thus resulting in an image having much scatter in the hair line. In Embodiment 2 and Comparative Example 2 wherein magnetic condensation is increased because of pole position regulation, a reduction in hair line uniformity by the endurance was seen. Particularly in Comparative Example 2, the toner circulation is weak and the magnetic condensation amount becomes great and therefore, the reduction in hair line uniformity was great.

Also in Comparative Example 3, the magnetic condensation was absent at the initial stage and therefore, good hair line uniformity was obtained, but due to the absence of the step portion on the regulating blade, the magnetic condensation was liable to occur during the endurance, and a reduction was seen in the hair line uniformity.

On the other hand, in Embodiment 1, the upper layer toner on the developing sleeve can be effectively stripped off by the step portion of the regulating blade to thereby shorten the magnetic ear, and the diametral magnetic field Br on the abutting portion of the regulating blade is made small and the magnetic field applied simultaneously with the stress is reduced to thereby suppress the occurrence of the magnetic condensation. Also, the magnetic field Br in the separating portion of the regulating blade is made great to thereby generate a strong magnetic field travelling from the abutting portion toward the separating portion and thereby promote the circulation of the toner, thus preventing the toner from stagnating near the abutting portion and concentratively receiving the stress and being extremely deteriorated. Accordingly, the production of the magnetic condensation during the endurance was little and the hair line uniformity was stable and good.

In Embodiment 3 and Comparative Example 1, as in Embodiment 1, the magnetic condensation amount by the endurance was small and therefore, the hair line uniformity was good.

On the other hand, in Comparative Example 3 which is the magnetic mono-component developing type using a non-contact rigid sleeve, a strong magnetic field is necessary in the developing portion and therefore, the toner forms a long magnetic ear on the developing sleeve and thus, the uniformity of the hair line changes depending on the movement direction of the ear. Further, due to the endurance, the toner particles become liable to adhere to each other in a straight direction by the magnetic condensation and therefore, the magnetic ear was liable to become long, and the uniformity of the hair line was low throughout the endurance.

In Comparative Example 6 using a multi-pole magnet, the pole position is rotated and therefore, the toner present near a strong pole positively forms a long magnetic ear to thereby reduce the hair line uniformity. Further, the magnetic condensation was liable to occur, and the hair line uniformity was reduced by the endurance.

On the other hand, Comparative Examples 7 and 8 adopt the nonmagnetic mono-component developing method using no magnetism, and do not form a magnetic ear and therefore, exhibited equal hair line uniformity in the circumferential direction and longitudinal direction of the developing sleeve, and the magnetic condensation by the endurance was null and the hair line uniformity was good.

6e) Evaluation of Image Edge Fault

In Comparative Examples 4 and 5 wherein the developing sleeve and the photosensitive drum are in non-contact with each other, the distance between the sleeve and the drum is great and in the image edge portion having a latent image potential difference, the developing electric field is liable to weaken in the surface direction of the drum (so-called edge effect), and further, the toner flies by an AC electric field irrespective of the image portion or the non-image portion with a result that the toner is swept up to the edge portion of the image. As the result, the edge portion of the image becomes dark, and causes a density difference relative to the central portion.

On the other hand, in Embodiments 1 to 3 and the other comparative examples wherein the developing sleeve and the drum are in contact with each other, it is possible to bring the sleeve which is a developing electrode into contact with the drum which is an opposed electrode to thereby generate a great developing electric field, and the edge effect and the sweeping of the toner to the edge portion can be reduced. Accordingly, there could be obtained a good image suffering little from the image edge fault.

6f) Evaluation of Solid Black Image Uniformity

Description will now be made of the result of the evaluation of solid black image uniformity. First, in the embodiments of the present invention, the developing efficiency is high and therefore, it is necessary to quickly supply a sufficient amount of toner onto the developing sleeve. Further, in Embodiment 1, the regulating blade is brought to higher potential on the same polarity side as the toner than the developing sleeve by the bias and therefore, the toner of the opposite polarity and the toner of a low charging amount are liable to be stripped off by an electric field, and it is necessary that a toner charged as uniformly as possible be sufficiently supplied to the upstream side of the regulating blade. So, in Embodiments 1 to 3, by a step portion and a separating portion being provided on the blade, a sufficient space could be secured upstream of the regulating blade and also the toner increased in the charging amount by being stripped off by the step portion was circulated by the separating portion, whereby the relatively charged toner could be again supplied to the developing sleeve to thereby reproduce a uniform solid black image.

However, the solid black image uniformity in the present invention depends on the shape of the regulating blade and the magnetic pole arrangement of the magnet, and in Embodiment 1 wherein the magnetic poles are arranged in the separating portion, the circulated toner was held in the separating portion to thereby obtain a uniform solid black image, whereas in Comparative Example 1 wherein both of the abutting portion and the separating portion are disposed between the magnetic poles, there was seen a reduction in the solid black image uniformity. This seems to be because in the step portion, the toner is liable to be stripped off from the developing sleeve and moreover, it is difficult for the toner to be held on the separating portion by a magnetic force and therefore, in the second and subsequent rounds of the developing sleeve, the density was reduced and the uniformity of the solid black image was reduced.

In Comparative Example 2, the regulating blade adopts pole position regulation and therefore, as compared with Comparative Example 1, the stripping-off on the step portion weakened and the uniformity of solid black was improved, but not so much as in Embodiments 1 to 3.

In Comparative Example 3, the regulating blade lacks the step portion, but a pole position is disposed in the separating portion of the blade and therefore, substantially uniform solid black was obtained.

In Comparative Examples 4 and 5 using the magnetic non-contact development, the developing efficiency is rather low and therefore, the toner coat in the solid black print was relatively earlier to stabilize than in Comparative Example 1, and uniform solid black was easy to obtain.

Also, in Comparative Example 6, the magnet is rotated, whereby the magnetic fields in the regulating portion and the developing portion are vibrated and therefore, some reduction in solid black uniformity was seen.

On the other hand, Comparative Examples 7 and 8 using the nonmagnetic contact development, like Comparative Example 1, have high developing efficiency, but it is easy to uniformize the toner state upstream of the regulating blade by the stripping-off and supplying roller and therefore, good solid black uniformity was obtained.

As described above, in the present invention, by the step portion and the separating portion being provided on the regulating blade, the space between it and the developing sleeve was enlarged, and the relatively charged toner stripped off by the regulating blade could be made easy to circulate in the gap portion between the blade and the sleeve.

Further, by the magnetic poles being arranged in the separating portion of the regulating blade, it became possible to sufficiently hold the stripped-off and circulated toner, and suitably supply it during solid black development, and the adoption of such a construction enabled stable solid black image uniformity to be obtained.

6g and 6h) Evaluation of Ghost

Description will now be made of the result of the evaluation of ghost. First, as regards the initial ghost, in Embodiment 2 and Comparative Examples 2 and 5 using pole position regulation, a slight positive ghost (rise in halftone density after black development) occurred. Also, in Comparative Example 1 wherein both of the abutting portion and separating portion of the blade are between the poles, a negative ghost (reduction in halftone density after black development) occurred.

Further, the ghost during the endurance relatively has a correlation with the magnetic condensation amount, and in Embodiment 1 and Comparative Example 1 wherein the magnetic condensation amount is small, the ghost during the endurance was not seen, and in Embodiments 2 and 3 and Comparative Example 3 wherein the magnetic condensation occurs, a slight ghost was seen, and further in Comparative Example 2 wherein the magnetic condensation amount is great, the ghost was aggravated.

Also, in Embodiment 3 and Comparative Example 4, the magnetic condensation amount was small, but a slight positive ghost occurred. This seems to be because the blade and the sleeve were brought to the same potential or the float potential and therefore, unlike the other embodiments, there was not the improvement in the toner charging amount by the electric field, and after the endurance during which the chargeability was reduced by the magnetic condensation, the toner charging amount after black development was reduced and the developing property was changed. Likewise, in Comparative Example 5 which lacks the charging of the toner by a blade bias, the ghost after the endurance was aggravated by an increase in magnetic condensation.

On the other hand, in Embodiment 1, good image formation free of a ghost was performed both at the initial stage and after the endurance.

Also in Comparative Examples 7 and 8 wherein the stripping-off and supplying roller is disposed, image formation free of a ghost was performed during the endurance.

Here, description will be made of the mechanism of occurrence of ghost image fault. In the developing apparatus according to the present embodiment comprising a photosensitive member and a developing sleeve urged against it, and having no stripping-off and supplying roller, a fresh toner is supplied to that portion of the elastic sleeve which has consumed the toner in the previous round and is conveyed to the regulating portion, but during the printing of solid black, about 90% or more of the toner forming the coat amount is consumed. On that portion of the elastic sleeve which has consumed the toner (black print), the fresh toner is supplied onto the elastic sleeve at a high percentage relative to the unconsumed and residual toner, and is conveyed to the regulating portion. On the other hand, on a portion which has not consumed the toner in the previous round (white print), the toner on the elastic sleeve is substantially intactly to the supplying portion and therefore, the fresh toner is supplied onto the elastic sleeve at a low percentage relative to the unconsumed and residual toner, and is conveyed to the regulating portion. That is, the toner conveyed to the regulating portion causes a difference in the percentages of the fresh and old toners due to the hysteresis of the toner consumption in the previous round. Here, between the fresh and old toners, the frequency of passage over the blade and the drum differs and therefore, these toners may have different charging amounts and particle diameters and accordingly, the difference between the percentages of the fresh and old toners leads to a different developing property in a halftone image, and causes the occurrence of a ghost image.

Here, if it can be made possible to sufficiently effect the change of places of the upper layer and lower layer in the toner layer immediately before and when the toner passes the regulating portion, that is, appropriately strip off and supply the toner in each round of the sleeve, the distribution of the charges imparted to the fresh and old toners can be made uniform, and irrespective of the hysteresis of the toner consumption, there is formed a toner layer having uniform charges imparted thereto after the passage over the regulating portion, thus obtaining a uniform halftone image free of the appearance of a ghost image. On the other hand, if the change of places of the upper layer and lower layer in the toner layer immediately before and when the toner passes the regulating portion, that is, the stripping-off and supply of the toner, cannot be sufficiently effected, a ghost image fault will occur to a uniform halftone.

By effecting the regulation of the developer by the regulating blade at an inter-pole position, the magnetic restraining force by the regulating portion can be weakened, and the replaceability, i.e., the stripping-off and supplying property, of the fresh and old toners can be improved to thereby suppress the ghost image fault. By adopting the inter-pole position regulation, a similar effect is also achieved in Embodiments 1 and 3, Comparative Example 3, and Comparative Example 4 using the non-contact developing type which is low in developing efficiency, and at the initial stage, there was obtained a uniform halftone free of a ghost.

Also, in the developing apparatus according to the present embodiment wherein most (about 90%) of the toner on the elastic sleeve is consumed during black development, it is necessary to quickly and sufficiently supply a toner amount corresponding to the consumed toner amount before the next passage over the regulating portion. In Comparative Example 1 wherein the abutting portion and separating portion of the blade are disposed between the magnetic poles, Br near the regulating blade, i.e., the magnetic force working toward the sleeve, is weak, and sufficient toner supply to the abutting portion was not effected and a negative ghost at the initial stage occurred. On the other hand, in Embodiments 1 to 3, the magnetic poles are brought to the separating portion of the blade to thereby make sufficient toner supply possible.

Further, by decreasing the amount of magnetic condensation occurring during the endurance, the occurrence of the ghost during the endurance can be suppressed. This is considered to be because a magnetically condensed toner lump is bad in fluidity and the stripping-off property from the developing sleeve was reduced, and the change of places of the upper layer and lower layer in the toner layer on the sleeve immediately before and during the passage over the regulating portion was not sufficiently effected, and the toner became liable to be more affected by the hysteresis of development. In Comparative Example 2 wherein magnetic condensation is liable to occur in a great deal, the level of the ghost after the endurance was bad, and in Embodiment 2 and Comparative Example 3 wherein a medium degree of magnetic condensation occurred, a slight ghost occurred.

In addition, to prevent the ghost, there is also required the rising property of charge imparting for causing the newly supplied toner to reach proper specific charge. In Embodiment 1, −100V which is a voltage of the same polarity side as the toner with respect to the developing sleeve is applied to the regulating blade, and it became possible to positively negatively charge even the toner reduced in chargeability by magnetic condensation. Accordingly, the rising property of the charge imparting during the endurance could be improved, and even if a small amount of magnetic condensation occurred, a uniform halftone image free of a ghost was obtained. On the other hand, in Embodiment 3, the potential of the regulating blade is made the same as the potential of the elastic sleeve, and by a reduction in the chargeability of the magnetically condensed toner, a difference in charging amount occurred between the fresh and old toners and thus, in Embodiment 3, a slight positive ghost occurred after the endurance.

That is, to improve the ghost in the present system which is high in developing efficiency, it is necessary to improve the good replaceability (stripping-off and supply) of the toner and a uniform charge imparting property. Accordingly, in the system of the present invention, firstly, regarding the stripping-off, the magnetic force was weakened by inter-pole regulation and at the same time, the toner having low specific charge was stripped off and separated from the developing sleeve substantially in the diametral direction of the developing sleeve.

Also, by the magnetic poles being arranged in the separating portion which is the upstream portion of the blade, a sufficient amount of toner could be supplied to the vicinity of the developing sleeve and further, the separating portion of the blade could again circulate and supply the toner once stripped off by the regulating blade and relatively charged to the developing sleeve to thereby form a toner layer having a proper value and a uniform charge distribution after the passage over the regulating blade, irrespective of the presence or absence of toner consumption. By the reason set forth above, it became possible to suppress the ghost image fault in the system of the present invention.

(1-6i) Evaluation of Ripple Image Fault

Description will now be made of a ripple image fault under a low-humidity environment. First, describing the mechanism of the ripple image fault under a low-humidity environment, the charging amount of the toner is liable to become excessive under the low-humidity environment in which the-toner is liable to be charged to a high charging amount, and when an excessively charged toner is produced in the lower layer toner in the toner layer on the developing sleeve, the toner becomes difficult to strip off from the surface of the developing sleeve because of a so-called image force, and the change of places of the fresh and old toners becomes impossible. Here, the toner layer on the surface of the developing sleeve which is high in charging amount hinders the charge imparting to the toner newly supplied to the developing sleeve, and forms an extremely uneven charge distribution and an uneven coat layer thickness in the toner layer after having passed the regulating blade. That is, when the charging amount of the toner high and the replaceability of the toner was low, a ripple-shaped coat fault occurred, thus causing the occurrence of a ripple image fault.

First, in Comparative Example 3, a bias of −100V with respect to the developing sleeve was given to the regulating blade to thereby raise the charge imparting property to the toner, nevertheless due to the absence of the step portion on the regulating blade, the toner of a low charging amount on the developing sleeve could not be stripped off, but a ripple image fault occurred.

In Embodiment 2 and Comparative Example 2, a slight ripple image fault occurred. This seems to be because the abutting portion of the blade was at the magnetic pole position and therefore, the magnetic restraining force of the toner heightened and the toner of a low charging amount on the developing sleeve became difficult to strip off.

In Embodiment 1, the inter-pole position is disposed at the blade abutting position and therefore, in a state in which the magnetic restraining force was made small relative to the thickness direction of the toner layer, it became possible to effectively strip off the toner by the step portion, and even under a low-humidity environment in which the toner charging amount is high, good image formation became possible without causing an extremely uneven charge distribution and an uneven coat layer thickness.

Also, regarding Comparative Examples 4 and 5 wherein a metallic rigid sleeve is used as the developing sleeve, it was likewise difficult for the ripple image fault to occur in Comparative Example 4 using the inter-pole regulation, and the ripple image fault was liable to occur in Comparative Example 5 using the pole position regulation.

On the other hand, in Comparative Example 6 using rotary magnetic poles, a ripple image fault occurred, and this is considered to be because the magnetic field in the regulating portion was vibrated and therefore the regulation of the toner amount became unstable.

Also, in Comparative Examples 7 and 8 using the stripping-off and supplying roller, the change of places of the toner is promoted and therefore, the excessive charging of the toner could be prevented, whereby it was difficult for the ripple image fault to occur.

Example 2 of the image forming apparatus will now be described on the basis of Table 2.

(1-6j) Cleaner-Less Collectability

First, in Comparative Examples 4 and 5 which are the non-contact developing type, the distance between the developing sleeve and the photosensitive drum becomes great and therefore, the toner residual as the untransferred toner on the photosensitive drum is weak in magnetic collecting force and electrical collecting force relative to the toner returned to the developing portion (hereinafter referred to as the returned toner) and thus, the collection rate was reduced. As the result, an image fault occurred after the printing of a high coverage rate image.

On the other hand, in the embodiments and Comparative Examples 1, 2, 3, 6, 7 and 8 wherein the photosensitive drum and the toner carrying member are in contact with each other, the intensity of the electric field between the developing sleeve and the photosensitive drum was greatly increased. Accordingly, by the utilization of the potential difference between the potential (V1 in the case of solid black) of the print portion and the development bias, the toner was shifted from the toner carrying member to the photosensitive drum to thereby effect reversal development and at the same time, by the utilization of the potential difference between the potential (Vd) of the non-print portion and the development bias, the untransferred (returned) toner on the photosensitive drum was shifted onto the toner carrying member and could be collected.

Accordingly, a good image free of any image fault was obtained even after the printing of a high coverage rate image having much untransferred toner.

(1-6k) Halftone Image Fault

First, in Comparative Examples 7 and 8 using the non-magnetic mono-component development, the collection of the returned toner is effected in a cleaner-less system which is Example 2 of the image forming apparatus and therefore, a halftone image fault is liable to occur. This is because the supplying roller is in contact with the developing roller and the physical stress received by the toner is high, and when the cleaner-less system is used in such a construction, a condensed lump is liable to be caused by the returned toner or the deteriorated toner. Accordingly, Comparative Examples 7 and 8 remarkably caused the occurrence of a halftone image fault in the cleaner-less system.

Also, in Comparative Examples 4 and 5 using the non-contact development, collectability is bad and therefore, the influence of the returned toner was relatively small, and during cleaner-less collection, there did not occur a halftone image fault due to a coat fault attributable to the returned toner.

On the other hand, in Embodiments 1, 2 and 3 using the contact development, the influence of the returned toner is great, but use is not made of such stripping-off and supplying roller as in the nonmagnetic mono-component development and therefore, it is possible to suppress the mechanical stress to the toner. Further, good stripping-off is effected by the step portion of the blade and the magnetic pole position is disposed on the separating portion of the blade to thereby positively supply the toner, whereby it becomes possible to replace the toner on the developing sleeve and therefore, a good halftone image free of any image fault was obtained.

(1-6l ) Halftone Image Fault Due to Paper Dust

First, Comparative Examples 7 and 8 using the nonmagnetic mono-component development are both provided with a sponge-like supplying roller and therefore, when during cleaner-less collection, paper dust contained in the returned toner got mixed with the interior of the developing device, the paper dust adhered to the sponge-like supplying roller for supplying the toner to the developing roller, to thereby cause a reduction in the stripping-off and supplying property, and a halftone image fault occurred.

On he other hand, in Comparative Examples 4 and 5 using the non-contact development, collectability is bad and therefore, it is considered that the influence of the returned toner is relatively small, but in Comparative Example 5 using the pole position regulation, a slight image fault was caused in a halftone image by the influence of a foreign substance, the returned toner and a toner condensed lump. The reason for this seems to be that use is made of a rigid sleeve and the image force of the toner and the surface of the sleeve is high and therefore, the toner and the foreign substance are liable to adhere to the sleeve, and particularly in Comparative Example 5 using the pole position regulation which is bad in replaceability, even a small amount of returned toner caused a slight fault in a halftone image.

Here, in Embodiments 1, 2 and 3 which use the contact development, the influence of the returned toner is great, but use is not made of such a stripping-off and supplying roller as in the nonmagnetic mono-component development and therefore, an image fault, attributable to the sponge-like supplying roller does not occur. Also, the sleeve has an elastic layer on the metal, whereby the image force is reduced and therefore, replaceability is improved as compared with Comparative Examples 4 and 5. Accordingly, it was possible to suppress the halftone image fault due to the occurrence of a toner condensed lump having as its core the foreign substance contained in the returned toner. However, in the aforedescribed Comparative Example 2 wherein the toner is liable to stagnate, some halftone image fault occurred. On the other hand, in Embodiments 1, 2 and 3, good stripping-off is effected by the step portion of the blade and the magnetic poles are arranged on the separating portion of the blade, whereby the toner is positively supplied to thereby preferentially convey the toner by the magnetic force even if the paper dust is introduced and therefore, as compared with Comparative Examples 7 and 8 using a nonmagnetic toner, a stable halftone image during the cleaner-less collection could be reproduced.

Thus, in the contact developing type, the collectability of the toner is high and the influence of the returned toner and the paper dust contained therein is great and therefore, very high replaceability is required. In the contact developing type which is the system of the present invention, more sufficient toner is supplied to the separating portion of the blade by the magnetic poles and is effectively stripped off by the step portion, and the developing sleeve has an elastic layer whereby the electrical adhering force can be reduced to thereby realize high replaceability. As the result, a good halftone image could be obtained even if a condensed lump was formed and paper dust got mixed with a great amount of returned toner.

(1-6j) Solid Black Image Fault

As regards a solid black image fault, in Comparative Examples 4 and 5 using the non-contact development, an AC voltage as great as 1.8 kvpp is superimposed on the development bias and therefore, when under a high-humidity environment, paper dust was present between the developing sleeve and the drum, the leak of the development bias occurred to thereby cause the occurrence of a solid black image fault. On the other hand, in Embodiments 1 to 3 and Comparative Examples 1, 2, 3, 6, 7 and 8 using the contact development, there was no leak due to paper dust, and a good solid black image free of a solid black image fault was obtained.

(2) Relation Between the Shape of the Regulating Blade and the Magnetic Pole Arrangement Description will now be made of the relation between the shape of the regulating blade and the magnetic pole arrangement in Embodiment 1.

Figure 4:
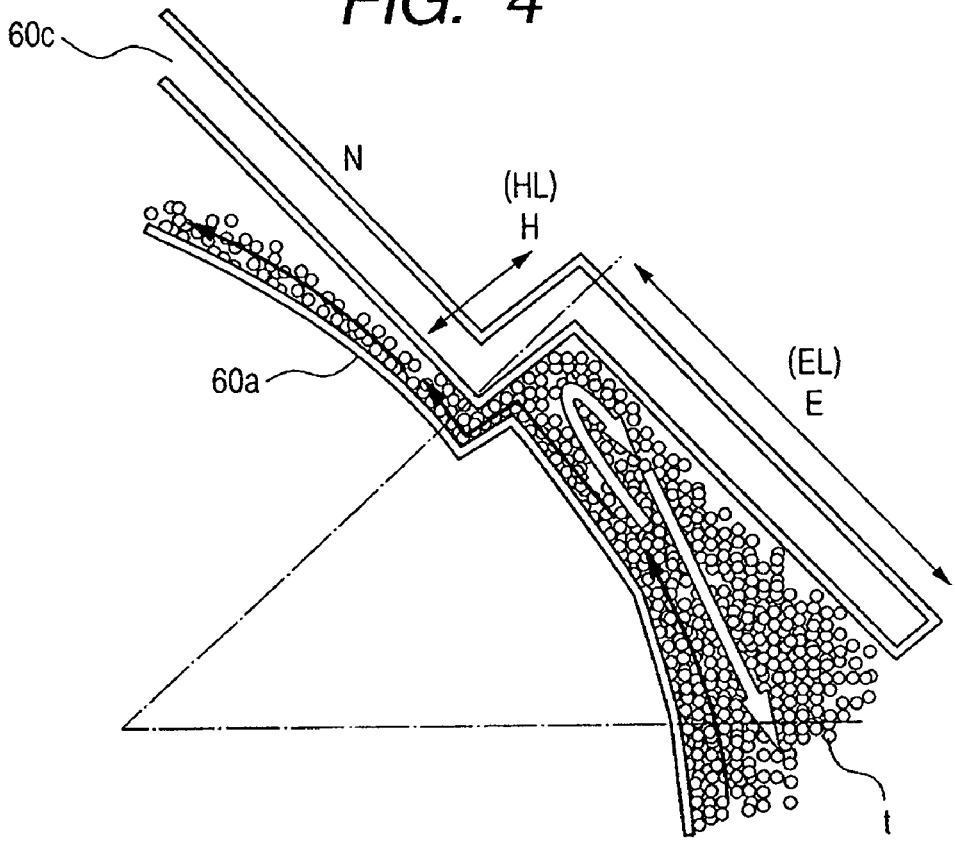
FIG. 4 is a schematic view of the vicinity of a regulating blade in Embodiment 1 of the present invention.

First, FIG. 4 shows the construction of the regulating blade 60*c* in the developing apparatus according to the present embodiment, and this regulating blade 60*c* is comprised of an abutting portion N abutting against a developing sleeve 60*a* having an elastic layer, a step portion H provided in a direction away from the developing sleeve and from the abutting portion N, and a separating portion E provided upstream of the step portion H with respect to the rotation direction of the developing sleeve.

The abutting portion N is a portion which directly presses and sufficiently frictionally charges the toner and therefore, it is necessary to uniformly give appropriate abutting pressure thereto in the longitudinal direction of the regulating blade. In the present embodiment, 20-100 N/m in terms of pulling-out pressure was given, whereby a proper toner coat was obtained.

The step portion H separates the toner on the developing sleeve into an upper layer and a lower layer, and effects coating with an appropriate layer thickness. In order to obtain sufficient separating performance in the present embodiment, the length (height) of the step portion H need have a predetermined or greater magnitude, and to make the circulation of the toner smooth, it need have an appropriate size. In the present embodiment, the length HL of the step portion H was set to 0.5-3 mm, whereby the effect of the present invention could be sufficiently obtained. When the length HL of the step portion was made smaller than 0.5 mm, it became equal to that in Comparative Example 3 wherein the blade is not provided with the step portion, and a ripple image fault under a low-humidity environment was liable to occur, and the levels of fog and ghost during the endurance were lowered. Further, when the length HL of the step portion H was set to 3 mm or greater, the uniformity of solid black was reduced. This seems to be because the circulation of the toner became too large and the toner separated from the developing sleeve, whereby the effect of the separating portion in the present invention became small.

The separating portion E controls the circulation of the toner on the upstream side of the regulating blade. The separating portion E forms a trapezoid space narrowing toward the downstream side with respect to the rotation direction of the developing sleeve between it and the developing sleeve, and effects the sufficient introduction of the toner from the end portions of the blade and also, returns the upper layer toner separated on the step portion H to the developing sleeve to thereby make stable toner supply toward the separating portion possible.

Here, it is preferable that the length EL of the separating portion E be 1-10 mm. When the length EL of the separating portion E was made less than 1 mm, it became difficult to store a sufficient amount of toner in the space between the blade and the sleeve when solid black was continuously printed, and the uniformity of solid black was sometimes reduced. Also, when the length EL of the separating portion E was 10 mm or greater, the route along which the toner was supplied to the developing sleeve was hindered, and a coat fault became liable to occur.

Further, as the relation between the lengths of the step portion H and the separating portion E, the length EL of the separating portion E was made equal to or greater than the length HL of the step portion H, whereby there were seen an improvement in hair line uniformity and an improvement in ghost by the good replaceability of the toner, and further an improvement in solid black uniformity.

Figure 5:
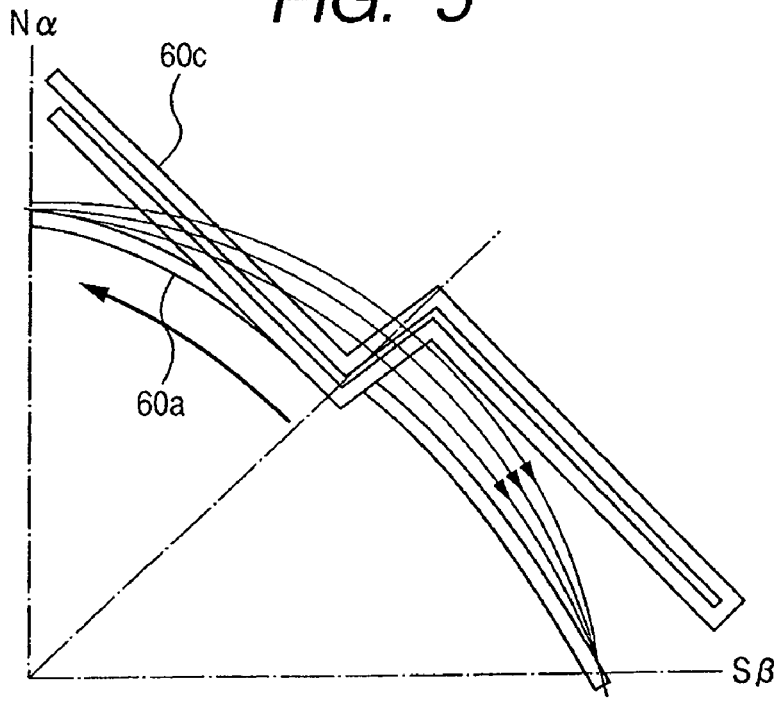
FIG. 5 is a schematic view of a line of magnetic force near the regulating blade in Embodiment 1 of the present invention.

The relation among the blade end portion position and abutting position and the magnetic poles in Embodiment 1 will be described here with reference to FIG. 5.

The separating portion of the regulating blade 60*c* is set to the vicinity of Sβ which is a proximate pole, whereby a line of magnetic force γ is formed from the step portion toward the upstream side with respect to the rotation direction. Accordingly, in the toner on the upper layer of the developing sleeve separated on the step portion, a magnetic force is generated in a direction back to the free end side of the separating portion by the line of magnetic force γ and therefore, the circulation of the toner upstream of the regulating blade is promoted. It seems that the toner continuously supplied with the rotation of the developing sleeve during a low coverage rate by this circulation of the toner excessively fills the step portion and the abutting portion and stagnates there to thereby achieve the effect of preventing the toner from being suddenly deteriorated and magnetically condensed.

Also, the abutting portion of the regulating blade is set between poles Sβ and Nα which are proximate poles, whereby the effect of the above-described circulation of the toner is more enhanced.

Here, the abutting portion and separating portion of the regulating blade in the present embodiment, and the magnetic flux density distribution on the surface of the developing sleeve formed by the magnet roller disposed in the interior of the developing sleeve will be described with respect to Embodiments 4 to 11 and in addition, Comparative Examples 1, 2 and 8 to 10 by the use of Table 3.

Embodiments 4, 5, 6, 7, 8, 9, 10 and 11

The present embodiment basically corresponds to the developing apparatus 60*A* of Embodiment 1, but differs in the following points from Embodiment 1.

In the setting of the regulating blade, it is to be understood that the lengths of the separating portions of the blades are 3 mm, 3 mm, 1 mm, 3 mm, 1.5 mm, 1 mm, 3 mm and 1.5 mm.

In FIGS. 3A and 3B, it is to be understood that the abutting positions θ of the regulating blades are 46°, 25°, 28°, 31°, −14°, 25°, 40° and 28°. |Br|/|B| of the abutting portions in this case are 0.17, 0.55, 0.45, 0.33, 0.84, 0.55, 0.03 and 0.45. Also, |Br|/|B| of the separating portions in this case were 0.55, 0.99, 0.64, 0.91, 0.50, 0.72, 0.72 and 0.8.

As the magnetic flux density in the separating portion, use was made of the magnetic flux density at the point of intersection between a straight line linking the end portion of the separating portion and the center of the developing sleeve together and the surface of the developing sleeve.

Comparative Examples 1, 2, 9, 10 and 11

The present embodiment basically corresponds to the developing apparatus 60A of Embodiment 1, but differs in the following points from Embodiment 1.

In the setting of the regulating blade, it is to be understood that the lengths of the separating portions of the blades are 3 mm, 3 mm, 1 mm, 3 mm and 0.5 mm. Also, in FIGS. 3A and 3B, it is to be understood that the abutting positions θ of the regulating blades are 52°, −14°, 40°, 49° and −23°. |Br|/|B| of the abutting portions in this case are 0.4, 0.84, 0.29, 0.59 and 0.03. Also, |Br|/|B| of the separating portions in this case were 0.33, 0.16, 0.46, 0.40 and 0.24.

TABLE 3

| | abutting portion \|Br\|/\|B\| Bn | separating portion \|Br\|/\|B\| Be | magnetic condensation amount | hair line uniformity | solid black uniformity |
|---|---|---|---|---|---|
| Embodiment 1 | 0.03 | 0.96 | small | ○ | ○ |
| Embodiment 2 | 0.80 | 0.77 | medium | Δ | ○ |
| Embodiment 4 | 0.17 | 0.55 | small | ○ | Δ |
| Embodiment 5 | 0.55 | 0.99 | medium | Δ | ○ |
| Embodiment 6 | 0.45 | 0.64 | small | ○ | Δ |
| Embodiment 7 | 0.33 | 0.91 | small | ○ | ○ |
| Embodiment 8 | 0.84 | 0.5 | medium | Δ | ○ |
| Embodiment 9 | 0.55 | 0.72 | medium | Δ | ○ |

TABLE 3-continued

| | abutting portion \|Br\|/\|B\| Bn | separating portion \|Br\|/\|B\| Be | magnetic condensation amount | hair line uniformity | solid black uniformity |
|---|---|---|---|---|---|
| Embodiment 10 | 0.03 | 0.72 | small | ○ | ○ |
| Embodiment 11 | 0.45 | 0.8 | small | ○ | ○ |
| Comparative Example 1 | 0.4 | 0.33 | medium | Δ | X |
| Comparative Example 2 | 0.84 | 0.16 | great | X | Δ |
| Comparative Example 9 | 0.29 | 0.46 | small | ○ | X |
| Comparative Example 10 | 0.59 | 0.4 | great | X | Δ |
| Comparative Example 11 | 0.03 | 0.24 | small | ○ | X |

In the following, the superiority of the present invention will be shown in the relation between the abutting position of the regulating blade against the elastic sleeve and the magnetic poles and the range of the coat amount. Specifically, Embodiments 1 to 11 and Comparative Examples 1, 2 and 9 to 11 will be described.

(2-1) Evaluation of Hair Line Uniformity

Figure 12:
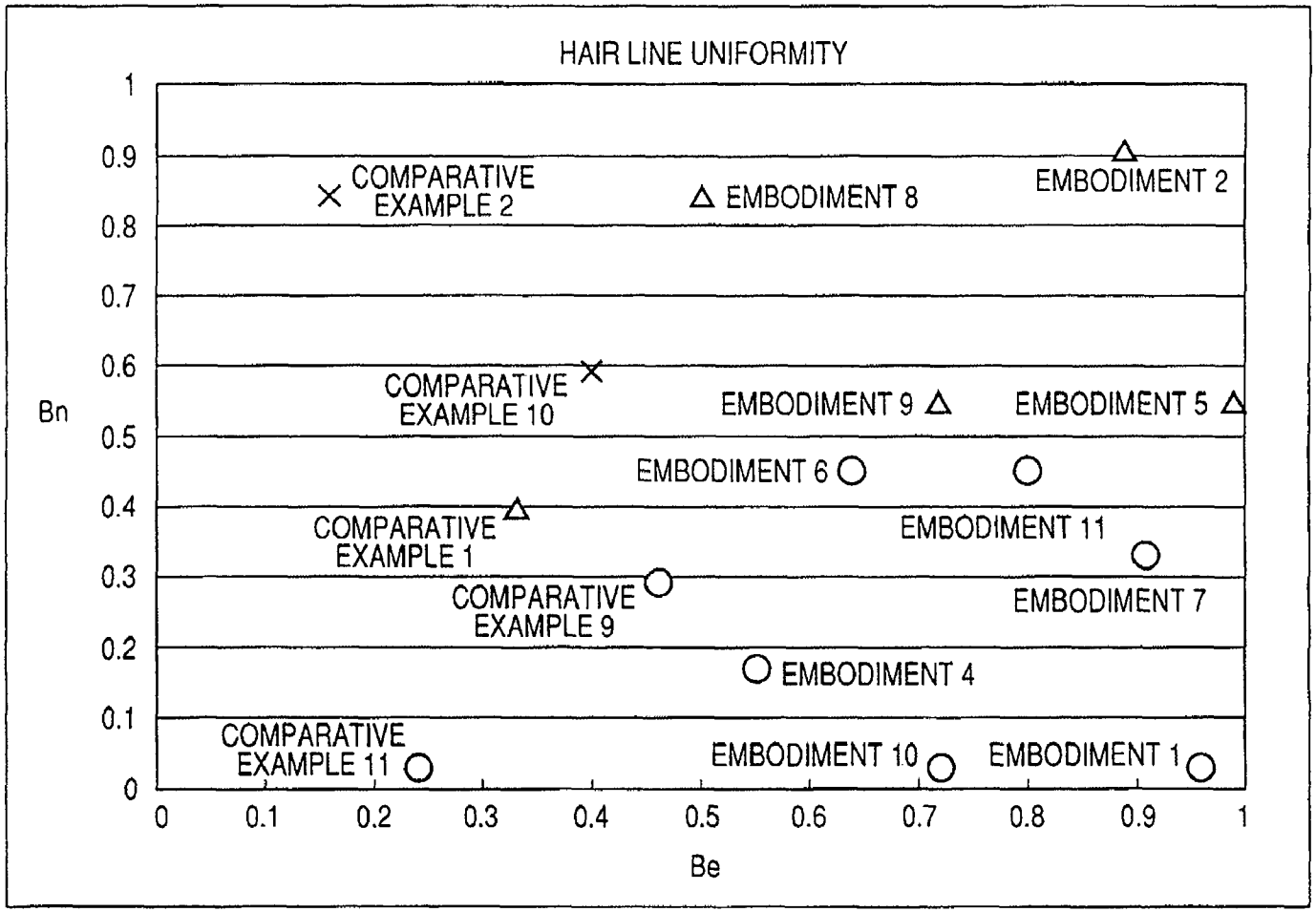
FIG. 12 is a graph of the result of evaluation of hair line uniformity.

At first, d) the result of the evaluation of hair line uniformity is shown in FIG. 12. Hereinafter, the magnetic flux density ratio (|Br|/|B|) in the diametral direction in the abutting portion will be expressed as Bn, and the magnetic flux density (|Br|/|B|) in the diametral direction in the separating portion will be expressed as Be.

In Embodiments 1, 4, 6, 7, 10 and 11, good hair line uniformity are obtained, but here, the magnetic flux density ratio in the separating portion is Be>0.5 and the magnetic flux density ratio in the abutting portion is Bn<0.5, and in the separating portion, it corresponds to the pole position, and in the abutting portion, it corresponds to the inter-pole position. In such a situation, such a line of magnetic force γ as shown in FIG. 5 is formed around the regulating blade and therefore, a magnetic force working on the upstream side with respect to the rotation direction of the developing sleeve along the arrow of the magnetic line of force γ acts on the toner stripped off from the developing sleeve by the step portion. Accordingly, good toner circulation is obtained without the toner stagnating near the step portion and the abutting portion. It seems that the good change of places of the toner was thus effected with a result that the magnetic condensation amount was decreased and the magnetic ear was maintained at an appropriate length, whereby the hair line uniformity was good.

In Comparative Examples 9 and 11, the magnetic flux density ratio in the separating portion is Be<0.5, but the magnetic flux density ratio in the abutting portion is Bn<0.3, and both of the separating portion and the abutting portion corresponds to the inter-pole position. Under such a condition, the magnetic restraining force in the diametral direction in the abutting portion is weak and therefore the stress received in the abutting portion by the toner is little and also, the toner circulation in the diametral direction of the sleeve is promoted in the step portion and therefore, the localized deterioration of the toner can be suppressed. Accordingly, it seems that the occurrence of the magnetic condensation amount was suppressed and the magnetic ear was maintained at an appropriate length, whereby the hair line uniformity was good.

In Embodiments 2, 5, 8 and 9, the uniformity of hair line was somewhat reduced. This seems to be because the magnetic flux density ratio in the separating portion is Be≧0.5, but the magnetic flux density ratio in the abutting portion is Bn>0.5, and both of the separating portion and the abutting portion correspond to the pole position and therefore, with an increase in the magnetic restraining force in the abutting portion, the magnetic condensation amount was also increased, and the magnetic ear grew, whereby the hair line uniformity was somewhat reduced.

Comparative Examples 2 and 10 are worst in hair line uniformity, and the magnetic flux density ratio in the separating portion is Be<0.5 and the magnetic flux density ratio in the abutting portion is Bn>0.5, and the separating portion corresponds to the pole position and the abutting portion corresponds to the inter-pole position. This seems to be because the magnetic restraining force in the abutting portion was increased and also, a line of magnetic force worked in a direction in which the toner stagnated in the step portion and therefore, the magnetic condensation amount was greatly increased and the hair line uniformity was aggravated.

(2-2) Evaluation of Solid Black Uniformity

Figure 13:
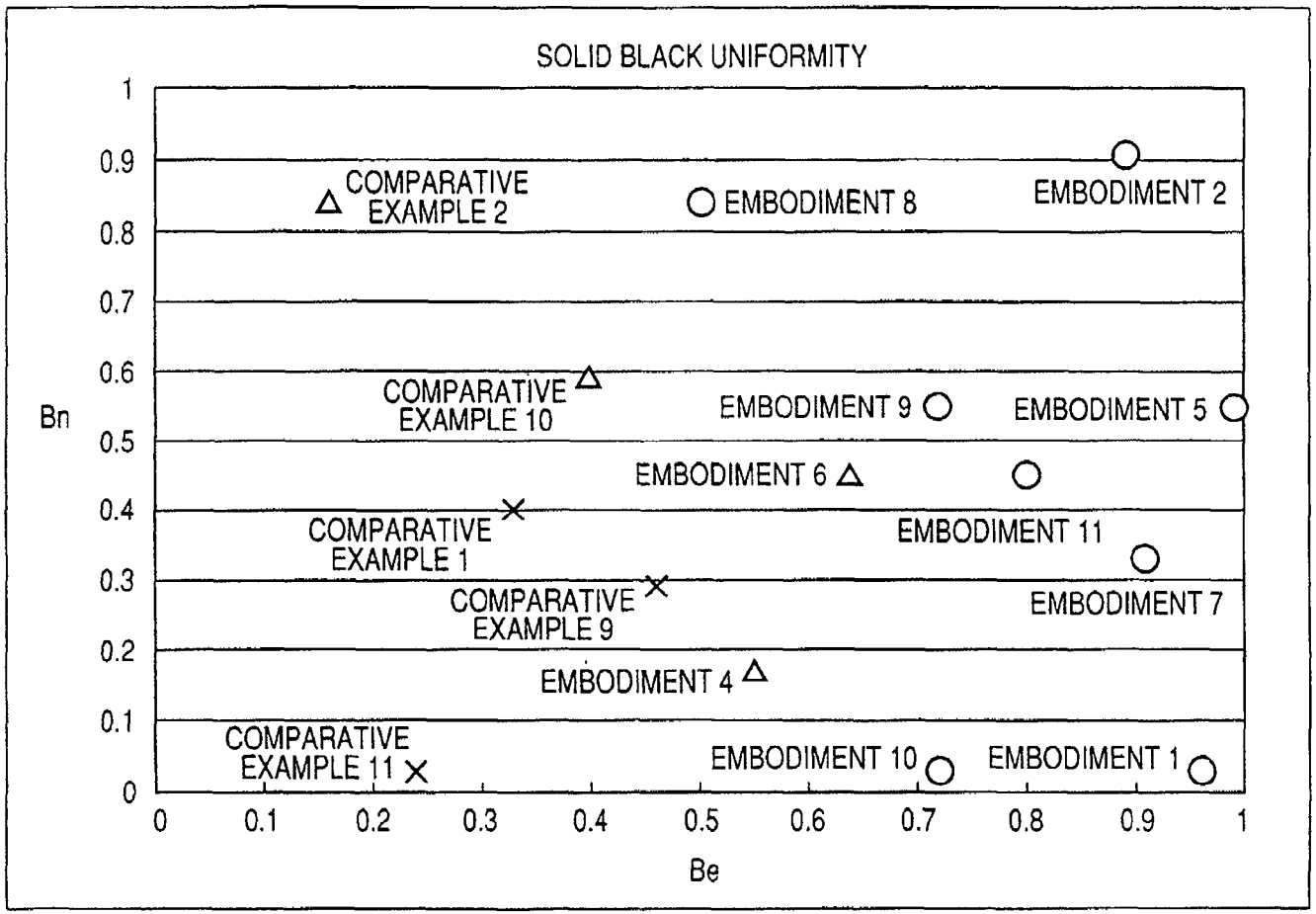
FIG. 13 is a graph of the result of evaluation of solid black uniformity.

The result of the evaluation of solid black uniformity will now be described with reference to FIG. 13.

In Embodiments 1, 2, 5, 7, 8, 9, 10 and 11, good black uniformity is obtained, but in these embodiments, the magnetic flux density ratio in the separating portion is Be≧0.5. This is because the stripping-off and supplying roller is absent, and to obtain good solid black uniformity in the developing apparatus of the present invention which is high in developing efficiency, it is necessary to uniformly supply a toner suitably having a charging amount in a sufficient amount to the upstream side of the abutting portion of the regulating blade, and it is made possible to circulate the toner stripped off from the developing sleeve in the step portion to the vicinity of the developing sleeve by the separating portion, and thereafter supply the toner onto the developing sleeve effecting solid black print on which little or no toner is present. The toner once stripped off from the developing sleeve is somewhat high in charging amount as compared with a fresh toner, and makes a stable toner coat which is relatively uniform in charging amount possible also in the developing apparatus according to the present embodiment which is high in developing efficiency.

Also, in Embodiments 4 and 6, the magnetic flux density ratio in the separating portion is Be≧0.5, but some reduction in density was seen in the second round of the developing sleeve.

On the other hand, in Comparative Examples 1, 9 and 11, the uniformity of a solid black image was bad, but the magnetic flux density ratio in the separating portion was Be<0.5 and the magnetic flux density ratio in the abutting portion was Bn<0.5. This seems to be because the supply of the toner in the separating portion is insufficient and moreover, the abutting portion is between the poles and therefore, design is made such that the toner on the sleeve is strongly stripped off by the step portion, and the density is liable to become non-uniform in the leading edge portion of a solid black image on which a uniform coat is formed by the toner being present on the developing sleeve a plurality of times in a state in which the toner is not consumed, and in the central portion to the trailing edge portion of the solid black image for supplying the toner onto the developing sleeve effecting solid black print on which little or no toner is present.

In Comparative Examples 2 and 10, however, the magnetic flux density ratio in the separating portion is Be<0.5, but solid black uniformity was relatively good. This seems to be became the magnetic flux density ratio in the abutting portion is rather great and therefore, in the step portion, a magnetic restraining force in the direction toward the developing sleeve worked on the toner, and the stripping-off by the step portion became small.

(2-3) Comprehensive Evaluation

Figure 14:
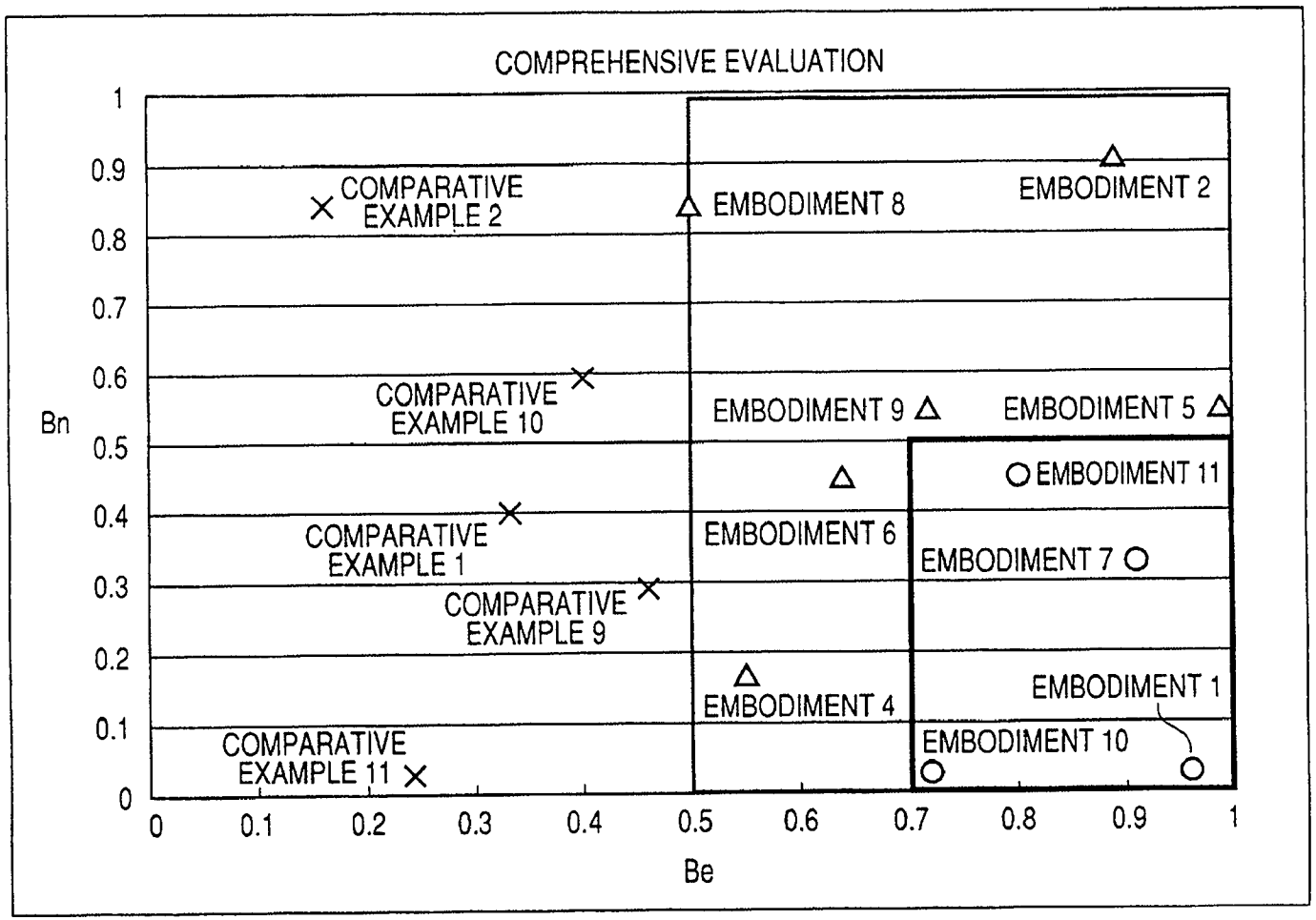
FIG. 14 is a graph of the result of comprehensive evaluation.

Summing up the result of the evaluation about Embodiments 1 to 11 and Comparative Examples 1, 2 and 8 to 10, when as shown in FIG. 14, the regulating blade was formed by the abutting portion, the step portion and the separating portion, and the magnetic flux density ratio (Be) on the developing sleeve in the separating portion was $|Br|/|B| \geqq 0.50$, there was obtained an image satisfying good hair line uniformity and solid black uniformity. Further, when the evaluation mentioned under the aforedescribed items (a) to (i) was effected in a developing apparatus using the present condition, a good image free of any image fault was obtained.

Also, more preferably, the magnetic flux density ratio (Be) on the developing sleeve in the separating portion is $|Br|/|B| \geqq 0.70$ and the magnetic flux density ratio (Bn) on the developing sleeve in the abutting portion is $|Br|/|B| < 0.50$ (the area in a black frame in FIG. 14), whereby there could be obtained an image satisfying better hair line uniformity and solid black uniformity.

(3) Description will now be made of an embodiment when an alternating electric field was applied to between the regulating blade and the developing sleeve.

Embodiment 12

Application of an AC Bias to the Regulating Blade in Embodiment 1

The present embodiment is such that the specification of the blade bias applying voltage source S5 in the developing apparatus of Embodiment 1 was changed, and an AC voltage (1 kHz, sine wave, peak-to-peak voltage 300V) was superimposed on a DC voltage of −450V and was applied.

Embodiment 12 is an example in which in contrast with Embodiment 1, an AC bias on the regulating blade is superimposed, but by the AC being applied, the solid black uniformity and the hair line uniformity during the endurance were further improved as compared with Embodiment 1. This is considered to be because the toner circulation in the separating portion of the regulating blade was promoted and the replaceability of the toner was improved.

Embodiment 13

Application of an AC Bias to the Developing Sleeve in Embodiment 1

The present embodiment is such that the specification of the development bias applying voltage source S2 in the developing apparatus of Embodiment 1 was changed, and an AC voltage (1 kHz, sine wave, peak-to-peak voltage 300V) was superimposed on a DC voltage of −450V and was applied.

Embodiment 13 is an example in which in contrast with Embodiment 1, an AC bias on the developing sleeve is superimposed, but by the AC being applied, the replaceability of the toner was improved as in Embodiment 12, whereby the solid black image uniformity and the hair line uniformity during the endurance were improved. Further, in Embodiment 13, an AC electric field is applied during development, whereby even in the case of a developing sleeve having a defect due to the adherence of a foreign substance or the like, it is difficult for a defective region to appear in an image, and a wide margin can be secured in the reproduction of a halftone.

As an alternating bias superimposed at this time, the effect in the present embodiment is obtained irrespective of a waveform such as a sine wave or a rectangular wave, but if the alternating bias is too great, hair line uniformity is reduced during the endurance as in the non-contact development of Comparative Examples 4 and 5. Also, when the maximum value $|V|max$ of the absolute value of the development bias became greater than the non-image portion potential Vd (dark potential) of the photosensitive drum, fog was suddenly aggravated. Accordingly, as a development bias having an alternating bias superimposed thereon, it is preferable that the relation between the maximum value $|V|max$ of the absolute value of the development bias and the non-image portion potential Vd (dark potential) of the photosensitive drum satisfy $|V|max \leqq |Vd|$, and particularly in the measurement of the fog on the drum after development, a clearer difference was seen.

Further, in the result of the evaluation of collectability by Example 2 of the image forming apparatus, there was obtained the result that the application of AC can make the collection rate higher.

(4) Thus, the developing apparatus according to the present invention can achieve an improvement in performance well balancedly for the problems (fog, solid black uniformity, ghost, hair line uniformity and image edge fault) peculiar to the conventional developing apparatus. Particularly, the solid black uniformity at the initial stage, and the fog and hair line uniformity during the endurance are improved by constituting the regulating blade by three portions (the abutting portion, the step portion and the separating portion, and keeping the relation between the positions of the abutting portion and the separating portion and the magnetic poles appropriate.

Further, the developing apparatus of the present invention is also effective in an image recording apparatus adopting a toner recycle system, and is effective for cleaner-less collectability, a halftone image fault, a halftone image fault due to paper dust, a solid black image fault, etc. Particularly in a cleaner-less system, when a great deal of fog due to magnetic condensation occurs, the stains of the charging roller occur and charging becomes entirely impossible, and a transfer material twines around a generally black image and further, around the fixing device to cause trouble to the apparatus, but this can be remarkably suppressed in the present invention.

Also, the above-described effect can be stably maintained even if there occur a variation with time, an environmental fluctuation, a fluctuation in the toner coat amount, etc.

Other Embodiments

1) While in the embodiments, a laser printer has been shown as the image recording apparatus, this is not restrictive, but of course, the image recording apparatus may be one of other image recording. apparatuses (image forming apparatuses) such as an electrophotographic copying machine, a facsimile apparatus and a word processor.

2) In the case of an electrostatic recording apparatus, the image bearing member as a member to be charged is an electrostatic recording dielectric member.

3) The developing apparatus according to the present embodiment is not restricted to a developing apparatus for the image bearing member (such as an electrophotographic photosensitive member or an electrostatic recording dielectric member), but of course, can be widely effectively used as developing process means (including collection) for a member to be developed.

As described above, the developing apparatus according to the present embodiment can achieve an improvement in performance well balancedly for the problems (fog, solid black uniformity, ghost, hair line uniformity and image edge fault) peculiar to the conventional developing apparatus. Particularly, the solid black uniformity at the initial stage and the fog and hair line uniformity during the endurance are improved by constituting the regulating blade by three portions (the abutting portion, the step portion and the separating portion, and keeping the positional relation thereof with the magnetic poles appropriate.

Further, the developing apparatus according to the-present embodiment is also effective in the image recording apparatus adopting the toner recycle system, and is effective for cleaner-less collectability, a halftone image fault, a halftone image fault due to paper dust, a solid black image fault, etc. Particularly, in the cleaner-less system, when a solid white image fault occurs, the stains of the transfer roller occur, and due to the stains of the charging roller, charging becomes entirely impossible and a generally black image is formed, and the transfer material twines around the fixing device, but this can be remarkably suppressed in the present invention.

Also, the above-described effect can be stably maintained even if there occur a variation with time, an environmental fluctuation, a fluctuation in the toner coat amount, etc.

1) At least a portion of the position of the developing sleeve to which the separating portion of the blade is opposed satisfies $|Br|/|B| \geqq 0.5$, and this is effective in the following points. That is, by a construction like the invention (1) being adopted, the developer is magnetically conveyed to the surface of the developer carrying member and therefore, a developer supplying roller is not required, and the stress given to the developer can be reduced. Further, by the developer amount regulating means being provided with a step portion, the stripping-off of the developer from the developer carrying member was improved, and by the developer amount regulating means being provided with a separating portion and the position thereof being kept proper, the sudden deterioration of the developer by stagnation was prevented and the occurrence of magnetic condensation during the endurance was suppressed. Further, by the DC bias applied to the developer carrying member, the formation of a long magnetic ear was suppressed even in a similar magnetic field during development, and it became possible to decrease the influence of the magnetic ear during development. Also, there was no image edge fault and uniform image reproduction was possible. This is because the developer carrying member having an elastic layer is brought into contact with the member to be developed to thereby effect DC development, whereby the developer is prevented from being swept up by the reciprocal movement of the developer.

2) The abutting portion on the developer amount regulating member is located in a relation which satisfies $|Br|/|B|<0.5$ with the magnetic flux density generated by the fixed magnetic field generating means, to thereby regulate in an area wherein a horizontal magnetic field is dominant to the developer, whereby the pressure force between the regulating member and the developer carrying member is small and therefore, the stress given to the developer can be reduced and also, a magnetic line of force for generating a magnetic force travelling from the abutting portion toward the separating portion can be generated and therefore, developer circulation for returning the developer stripped off in the step portion to the separating portion is promoted to thereby prevent the stagnation of the developer near the step portion of the developer amount regulating means and therefore, the occurrence of magnetic condensation due to the developer having locally received stress by the endurance is further suppressed, and even when the number of printed sheets (particularly during a low-coverage rate) is increased, the deterioration of the developer is remarkably suppressed to thereby prevent the occurrence of fog.

3) The developer amount regulating member has at least an electrically conductive member and voltage applying means for applying a DC bias to the electrically conductive member, and a bias of the same polarity as the developer relative to the developer carrying member is applied to the electrically conductive member to thereby promote the charge imparting to the developer in the abutting portion by an electric field. Further, in the step portion, the developer charged to the opposite polarity and the developer of a low charging amount are stripped off from the developer carrying member to thereby improve the chargeability of the developer on the developer carrying member after the passage over the developer amount regulating means, and suppress the occurrence of fog also in the developer during the endurance reduced in charging characteristic by magnetic condensation.

4) The developer amount regulating member has at least an electrically conductive member and voltage applying means for applying a DC bias having an AC bias superimposed thereon to the electrically conductive member, and the DC bias is a bias of the same polarity as the developer relative to the developer carrying member, whereby the average charging amount of the developer is increased by the DC bias and also, the developer circulation in the separating portion of the developer amount regulating means is promoted by the AC bias, and the occurrence of magnetic condensation can further suppressed to thereby strengthen the effect in the present invention.

5) The developer carrying member is provided with voltage applying means for applying a bias V having an AC bias superimposed on a DC bias, and the relation between the maximum value $|V|max$ of the absolute value of the development bias and a predetermined voltage value Vd (dark potential) for uniformly charging the surface of the image bearing member by the charging means satisfies $|V|max \leqq |Vd|$, and by adopting a construction in which the bias V is applied to the developer carrying member to thereby develop the member to be developed with the developer, the developer carrying member develops the member to be developed with the developer while pressing the member to be developed, together with the effect of item 4) above, whereby the tailing of the developer can be suppressed to thereby improve hair line uniformity.

6) The relation between the length L of the step portion and the length E of the separating portion of the developer amount regulating member is set to $L \leqq E$, whereby an improvement in hair line uniformity by the good replaceability of the developer, an improvement in ghost and further, an improvement in solid black uniformity can be achieved.

7) By adopting a construction in which the length H of the step portion of the developer amount regulating member is 0.5 mm or greater and 3 mm or less, the stability of the developer coat and the uniformity of solid black under a low-humidity environment can be improved by the promotion of the stripping-off and the circulation of the developer.

8) By adopting a construction in which the length H of the separating portion of the developer amount regulating member is 1 mm or greater and 10 mm, the circulation of the developer on the upstream side of the step portion of the developer amount regulating member is controlled, whereby there is obtained a good image free of an image defect attributable to uniform solid black and a developer coat fault.

11) The developing apparatus is further effective in the following points by collecting the untransferred developer residual on the image bearing member by the developing apparatus.

a: In the cleaner-less system, the image bearing member and the developer carrying member are urged against each other and brought into contact with each other, whereby the image bearing member and the developer carrying member come close to each other, whereby the electric field or the area in which the electric field works and the intensity thereof are increased, and the collectability of the untransferred developer adhering to the unexposed portion of the image bearing member can be improved.

b: In the cleaner-less system, the developer is a mono-component magnetic developer, and the developer is attracted to the developer carrying member by the fixed magnetic field generating means provided in the interior of the developer carrying member, whereby the developer is magnetically conveyed onto the developer carrying member and therefore, a developer supplying roller for supplying the developer onto the developer carrying member is not required and thus, the toner deterioration by the returned developer is suppressed, and the replaceability is improved by the regulation of the developer amount by the step portion of the developer amount regulating means, and the provision of an elastic layer lower than the specific dielectric constant of a metal and therefore, it is possible to suppress the occurrence of a developer condensed lump with a foreign substance contained in the returned developer as the core, and a halftone image fault due to the adherence of the developer condensed lump to the developer supplying roller.

c: Described in the Evaluation of the Halftone Image Defect by Paper Dust

In the cleaner-less system, the developer is a mono-component magnetic developer, and the developer is attracted to the developer carrying member by the fixed magnetic field generating means provided in the interior of the developer carrying member, whereby the developer is magnetically conveyed onto the developer carrying member and therefore, a developer supplying roller for supplying the developer onto the developer carrying member is not required and thus, when the number of printed sheets is increased, it is possible to suppress a halftone image fault in the period of the developer carrying member due to the faulty stripping-off and supply attributable to the paper dust contained in the returned developer being collected on the developer supplying roller due to the frictional contact between the developer supplying roller and the developer carrying member.

d: Described in the Evaluation of a Solid Black Image Defect

In the cleaner-less system, a DC voltage is applied as the development bias, and the developer carrying member develops the member to be developed with the developer while pressing the member to be developed, whereby the leak occurring with the paper dust contained in the returned developer during a high temperature and high humidity being returned can be suppressed to thereby suppress the image fault due to white spots in solid black.

e: In the cleaner-less system, a voltage satisfying $|V|max \leqq |Vd|$ and having an AC voltage superimposed on a DC voltage is applied as the development bias, and the developer carrying member develops the member to be developed with the developer while pressing the member to be developed, to thereby suppress the leak occurring with the paper dust contained in the returned developer during a high temperature and high humidity being returned, and an image fault due to white spots in solid black can be suppressed.

This application claims priority from Japanese Patent Application No. 2005-119980 filed on Apr. 18, 2005, which is hereby incorporated by reference herein.

What is claimed is:

1. A developing apparatus comprising:

a rotatable developer carrying member carrying a mono-component magnetic developer to develop an electrostatic image formed on an image bearing member with the mono-component magnetic developer, said developer carrying member being provided with an elastic layer on a surface of said developer carrying member, said developer carrying member being urged against said image bearing member;

non-rotary magnetic field generating means provided inside said developer carrying member for magnetically attracting the developer to said developer carrying member; and a developer amount regulating member contacting with said developer carrying member to regulate an amount of the developer carried on said developer carrying member, said developer amount regulating member being provided with an abutting portion provided while abutting in a counter direction to a rotation direction of said developer carrying member, and abutting against said developer carrying member, a step portion provided in a direction away from said abutting portion relative to said developer carrying member, and a separating portion provided upstream of said step portion with respect to the rotation direction of said developer carrying member, wherein when a magnitude of magnetic flux density formed on the surface of said developer carrying member by said magnetic field generating means is defined as B(G), and a component of the magnetic flux density B(G) in a direction perpendicular to the surface of said developer carrying member is defined as Br(G), the surface of said developer carrying member to which said separating portion is opposed includes a position satisfying $|Br|/|B| \geqq 0.5$.

2. A developing apparatus according to claim 1, wherein said abutting portion is provided at a position satisfying $|Br|/|B| \leqq 0.5$.

3. A developing apparatus according to claim 1, wherein a DC voltage of the same polarity side as the developer rather than said developer carrying member is applied to said developer amount regulating member.

4. A developing apparatus according to claim 1, wherein a superimposed voltage of a DC voltage of the same polarity side as the developer rather than said developer carrying member and an AC voltage is applied to said developer amount regulating member.

5. A developing apparatus according to claim 1, wherein during development, a superimposed voltage comprising a DC voltage and an AC voltage superimposed one upon the other is applied to said developer carrying member, and a relation between a maximum value $|v|max$ of an absolute value of the superimposed voltage and potential Vd at which said image bearing member is charged by charging means satisfies $|V|max \leqq |Vd|$.

6. A developing apparatus according to claim 1, wherein when a length of said step portion is defined as HL, and a length of said separating portion is defined as EL, $HL \leqq EL$ is satisfied.

7. A developing apparatus according to claim 1, wherein a length HL of said step portion is 0.5 mm or greater and 3 mm or less.

8. A developing apparatus according to claim 1, wherein a length EL of said separating portion is 1 mm or greater and 10 mm or less.

9. A developing apparatus according to claim 1, wherein said developing apparatus is provided in a cartridge detachably mountable on an image forming apparatus main body.

10. A developing apparatus according to claim 1, wherein a member with which said developer carrying member first contacts after it has contacted with said image bearing member is said developer amount regulating member.

11. A developing apparatus according to claim 1, wherein said developing apparatus can perform a developing operation and at the same time, perform a collecting operation of collecting the developer from said image bearing member.

12. A developing apparatus according to claim 2, wherein said developing apparatus can perform a developing operation and at the same time, perform a collecting operation of collecting the developer from said image bearing member.

13. A developing apparatus according to claim 5, wherein said developing apparatus can perform a developing operation and at the same time, perform a collecting operation of collecting the developer from said image bearing member.

14. A developing apparatus according to claim 6, wherein said developing apparatus can perform a developing operation and at the same time, perform a collecting operation of collecting the developer from said image bearing member.

15. A developing apparatus according to claim 7, wherein said developing apparatus can perform a developing operation and at the same time, perform a collecting operation of collecting the developer from said image bearing member.

16. A developing apparatus according to claim 8, wherein said developing apparatus can perform a developing operation and at the same time, perform a collecting operation of collecting the developer from said image bearing member.

* * * * *

UNITED STATES PATENT AND TRADEMARK OFFICE

CERTIFICATE OF CORRECTION

PATENT NO. : 7,379,693 B2
APPLICATION NO. : 11/402022
DATED : May 27, 2008
INVENTOR(S) : Kenya Ogawa et al.

It is certified that error appears in the above-identified patent and that said Letters Patent is hereby corrected as shown below:

TITLE PAGE ITEM [56] References Cited - FOREIGN PATENT DOCUMENTS:

Page 2, "JP 2005283845 A * 10/2005" should read --JP 2005-283845 A * 10/2005--.

COLUMN 12:

Line 48, "Sleeve 60r A" should read --Sleeve 60r ¶A--.

COLUMN 13:

Line 58, "100 µn" should read --100 µm--.

COLUMN 14:

Line 41, "examples. Various" should read --examples. ¶Various--.

COLUMN 17:

Line 22, "ov," should read --σv,--.

Line 32, "ov/oh" should read --σv/σh--.

COLUMN 21:

Line 52, "toner" should read --toner)--.

COLUMN 23:

Line 3, "adhere" should read --adheres--.

COLUMN 24:

Line 37, "liable-to" should read --liable to--.

COLUMN 29:

Line 62, "stripping-pff" should read --stripping-off--.

COLUMN 35:

Line 62, "intactly to" should read --intact on--.

COLUMN 37:

Lines 27 and 28, "the developing sleeve. ¶Also, by the magnetic poles being arranged in the sepa-" should read --the developing sleeve. Also, by the magnetic poles being arranged in the sepa- --.

Line 59, "toner high" should read --toner was high--.

UNITED STATES PATENT AND TRADEMARK OFFICE

CERTIFICATE OF CORRECTION

PATENT NO. : 7,379,693 B2
APPLICATION NO. : 11/402022
DATED : May 27, 2008
INVENTOR(S) : Kenya Ogawa et al.

It is certified that error appears in the above-identified patent and that said Letters Patent is hereby corrected as shown below:

COLUMN 38:
Line 38, “Cleaner-Less” should read --Cleaner-less--.

COLUMN 39:
Line 41, “he” should read --the--.

COLUMN 45:
Line 8, “became” should read --because--.

COLUMN 46:
Line 41, “portion,” should read --portion)--.
Line 67, “recording.” should read --recording--.

COLUMN 47:
Line 22, “portion,” should read --portion)--.

COLUMN 51:
Line 14, claim 5 “|v| max” should read --|V| max--.

Signed and Sealed this

Eleventh Day of November, 2008

JON W. DUDAS
*Director of the United States Patent and Trademark Office*